US006105527A

United States Patent [19]

Lochtefeld et al.

[11] Patent Number: 6,105,527

[45] Date of Patent: Aug. 22, 2000

[54] BOAT ACTIVATED WAKE ENHANCEMENT METHOD AND SYSTEM

[75] Inventors: Thomas J. Lochtefeld, La Jolla; Charles E. Sauerbier, Arroyo Grande, both of Calif.

[73] Assignee: Light Wave Ltd., La Jolla, Calif.

[21] Appl. No.: 09/097,650

[22] Filed: Jun. 16, 1998

Related U.S. Application Data

[63] Continuation-in-part of application No. 08/893,701, Jul. 11, 1997, Pat. No. 5,911,190, which is a continuation-in-part of application No. 08/769,695, Dec. 18, 1996, Pat. No. 5,860,766.

[51] Int. Cl.[7] ..... B63B 39/03

[52] U.S. Cl. ..... 114/125; 114/274

[58] Field of Search ..... 114/123, 271, 114/274, 280, 288, 290, 125, 61.29; 405/79

[56] References Cited

U.S. PATENT DOCUMENTS

| | | | |
|---|---|---|---|
| Re. 25,165 | 5/1962 | Pulsifier . | |
| 998,437 | 7/1911 | Wieland . | |
| 1,006,118 | 10/1911 | Napier . | |
| 1,184,207 | 5/1916 | Perrault . | |
| 1,736,157 | 11/1929 | Harter | 114/123 |
| 2,151,836 | 3/1939 | Bugatti . | |
| 2,414,480 | 1/1947 | Morrill . | |
| 2,544,599 | 3/1951 | Keelen | 114/123 |
| 2,584,347 | 2/1952 | Hazard . | |
| 2,767,678 | 10/1956 | Vertens | 114/274 |
| 2,983,508 | 5/1961 | Modine . | |
| 3,101,691 | 8/1963 | Wendt . | |
| 3,115,860 | 12/1963 | Payne . | |
| 3,139,055 | 6/1964 | Nutting . | |
| 3,199,483 | 8/1965 | Ellzey . | |
| 3,216,390 | 11/1965 | Molotzak . | |
| 3,343,513 | 9/1967 | Bader . | |
| 3,373,710 | 3/1968 | Steinberg | 114/274 |
| 3,481,297 | 12/1969 | Mantle . | |
| 3,503,358 | 3/1970 | Moesly | 114/125 |
| 3,613,622 | 10/1971 | Bueller . | |
| 3,638,598 | 2/1972 | Viad . | |
| 3,648,641 | 3/1972 | Normand, Jr. | 114/123 |
| 3,688,730 | 9/1972 | Ortieb et al. . | |
| 3,763,810 | 10/1973 | Payne . | |
| 3,977,347 | 8/1976 | With . | |
| 3,998,176 | 12/1976 | Stout et al. . | |
| 4,002,131 | 1/1977 | Mangrum . | |
| 4,003,325 | 1/1977 | Allen . | |
| 4,056,074 | 11/1977 | Sachs . | |
| 4,067,286 | 1/1978 | Stout et al. . | |
| 4,190,619 | 2/1980 | Cherne . | |
| 4,224,889 | 9/1980 | Spiegel . | |
| 4,233,920 | 11/1980 | Wood et al. . | |
| 4,351,262 | 9/1982 | Matthews . | |
| 4,361,102 | 11/1982 | Wood et al. . | |
| 4,437,842 | 3/1984 | Connor . | |

(List continued on next page.)

FOREIGN PATENT DOCUMENTS

| | | |
|---|---|---|
| 0061645 | 10/1982 | European Pat. Off. . |
| 2554409 | 5/1985 | France . |

*Primary Examiner*—Sherman Basinger
*Attorney, Agent, or Firm*—Dickinson Wright PLLC

[57] ABSTRACT

The present invention relates to a boat-activated wake enhancement method and system that extends from the boat. According to one aspect, a pair of protuberances is provided on the lower stem quarter of the boat's hull, primarily along the sidewalls. The protuberances are elongated and each has a rounded surface that extends substantially laterally outward in relation to the boat hull. The protuberances help to displace more water by increasing and shifting the effective width of the boat, causing the boat to travel deeper in the water, and creating additional interference that affects the natural wakes created by the boat. Additional inverted hydrofoil members and ballasts can also be provided to cause the boat to travel deeper in the water and therefore create larger waves. The present invention is used to increase the size and enhance the shape and location of the wake and/or waves for wakeboarding and wake surfing.

49 Claims, 16 Drawing Sheets

U.S. PATENT DOCUMENTS

| | | | |
|---|---|---|---|
| 4,458,622 | 7/1984 | Anderson . | |
| 4,484,534 | 11/1984 | de Boullay . | |
| 4,491,518 | 1/1985 | Benaroya et al. . | |
| 4,498,409 | 2/1985 | Edel . | |
| 4,507,094 | 3/1985 | Hennebutte . | |
| 4,606,291 | 8/1986 | Hoppe . | |
| 4,669,408 | 6/1987 | Schad . | |
| 4,821,663 | 4/1989 | Schad . | |
| 4,909,176 | 3/1990 | Kobayashi | 114/123 |
| 4,915,048 | 4/1990 | Stanford | 114/274 |
| 5,000,110 | 3/1991 | Moore . | |
| 5,088,433 | 2/1992 | Osawa et al. . | |
| 5,178,090 | 1/1993 | Carter . | |
| 5,263,430 | 11/1993 | Monfort . | |
| 5,282,436 | 2/1994 | Hansen . | |
| 5,315,951 | 5/1994 | Finkl . | |
| 5,362,269 | 11/1994 | Leach . | |
| 5,447,459 | 9/1995 | Hammond . | |
| 5,481,996 | 1/1996 | Osawa et al. . | |
| 5,482,485 | 1/1996 | Ball . | |
| 5,549,071 | 8/1996 | Pigeon et al. . | |
| 5,611,295 | 3/1997 | Stables . | |
| 5,787,835 | 8/1998 | Remnant | 114/271 |
| 5,860,384 | 1/1999 | Castillo | 114/280 |

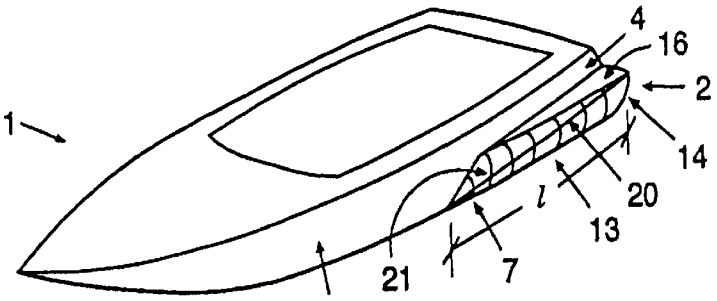
FIG. 1
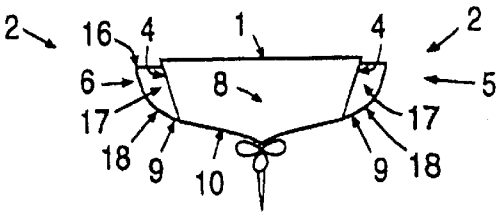
Rear View
FIG. 3
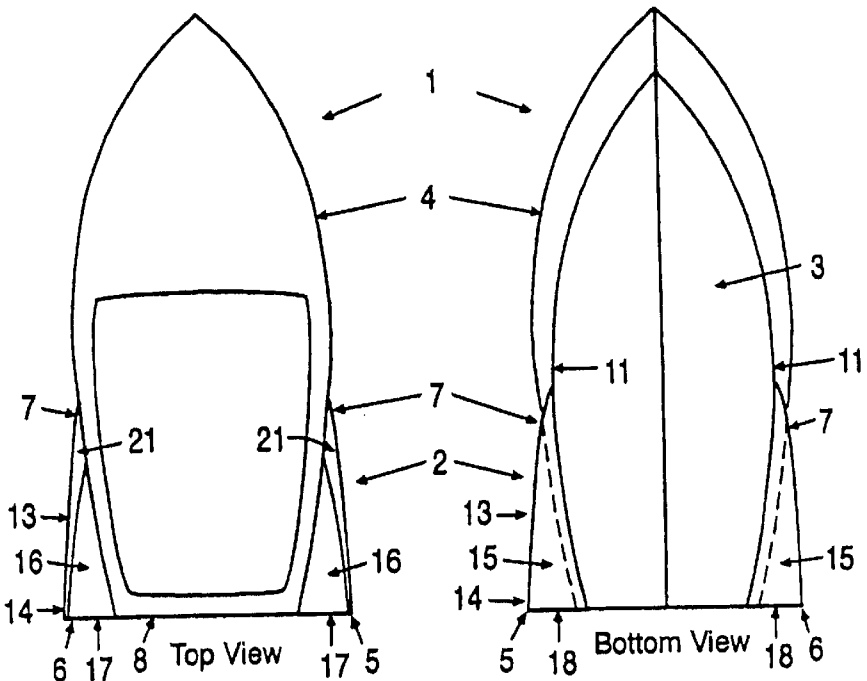
Top View
FIG. 2a
Bottom View
FIG. 2b 110
111
114
119
123
113
112
118
122

123
121
A
B
C
D
124
122

115
123
118
122
121
113
105
119
104
120
111
110

122
113
112
D
C
B
A
121
119
117
120
110
111

Side View

Top View

Side View

BOAT ACTIVATED WAKE ENHANCEMENT METHOD AND SYSTEM

RELATED APPLICATIONS

This application is a continuation-in-part of U.S. application Ser. No. 08/893,701, entitled "Boat Activated Wave Generator," which was filed on Jul. 11, 1997, and issued as U.S. Pat. No. 5,911,190 on Jun. 15, 1999, and U.S. application Ser. No. 08/769,695, entitled "Boat Activated Wave Generator," which was filed on Dec. 18, 1997, and issued as U.S. Pat. No. 5,860,766 on Jan. 19, 1999.

FIELD OF THE INVENTION

The present invention relates to the field of wake enhancement devices, and in particular, to a boat activated method and system for enhancing wakes for the sport of wakeboarding and wake surfing.

BACKGROUND OF THE INVENTION

Wakeboarding: The sport of wakeboarding has become increasingly popular in recent years. Wakeboarding typically involves using high speed boats equipped with a rope extending from the stem similar to those used in the sport of water skiing. Rather than skis, however, the wakeboarder's feet are normally strapped to a single, wider board, which allows the wakeboarder to skim sideways as well as forwards, while being pulled by the rope at somewhat slower speeds. As further distinguished from water skiing, the wakeboarder intentionally interacts with the boat's wake by using various elements of the wake to perform intricate maneuvers on and above the waves within the wake pattern. By crossing the wake transversely at high speeds, for example, a wakeboarder can utilize the first steep crest as a launch ramp to jump and cartwheel across the entire wake to land on the opposite side. By design, the wakeboard enables wakeboarders to skim over and across the wake, using the slope of the moving waves to perform maneuvers, such as jumps, ramps, turns, launches, etc.

A relatively long rope is typically attached at an elevated connection point at the boat's midpoint to enable skilled wakeboarders to maneuver freely behind the boat in both vertical and horizontal directions. With sufficient practice, skill and training, weight can be applied and shifted to adjust the wakeboard's position and angle relative to the moving waves, carving the board's edges into and across the waves, and using the rope for acceleration, guidance and control. For example, by cutting the wake board at an angle oblique to the direction of travel, the wakeboarder can 'load' the rope, accelerate, hit the wake, and become airborne, achieving sufficient "hang time" and/or allowing the wakeboarder to perform desired acrobatic maneuvers.

An important element in the wakeboarder's repertory is the wake itself. For purposes of this invention, "wake" is defined as the wave pattern behind a moving boat that is generated by its passage through the water. This pattern normally arises from the "constructive" and "destructive" interference that occurs between divergent stem or bow waves and transverse body waves, whose size and character are related to the boat's length, shape, displacement, trim, and speed relative to the water. The quality and size of the wakes created by the boat significantly affect the wakeboarder's ability to achieve height on jumps and to perform the acrobatic maneuvers that are the essence of the sport.

Unfortunately for wakeboarders, conventional water ski boats are not designed to make waves but, rather, to minimize them in order to minimize power and to provide the smooth wake patterns that high speed skiing requires. Thus, the goal of traditional ski boat design is to lessen displacement, decrease drag, and enable the boat to travel faster with less energy. This is achieved, for example, by light displacement, straight after-buttock lines, a shallow-V bottom, and a bluff transom, so that the boat operates at high speed in a fully planing mode.

In order to generate an increase in wake size, wakeboarders have attempted to overcome the design objectives of traditional water ski boats by adding static ballast to the boat. Such ballast is usually in the form of water filled bags, concrete blocks, or other such weighted objects that disadvantageously occupy inboard passenger space. One other significant disadvantage to static ballast is that it can easily lead to an unsafe overload condition and scuttling.

Wake Surfing: In addition to wake boarding, a novelty sport, occasionally performed in the wave pattern behind a boat, is "wake surfing." This involves performing surfing maneuvers on a conventional surfboard in the wake of a boat, but without the benefit of a tow rope. Wake surfing maneuvers are entirely akin to those performed on natural ocean coastlines. The predominant factor that has limited the popularity and growth of wake surfing as a full-fledged sport has been the lack of boats capable of making good surfable waves at a safe distance behind the boat. More so than wakeboarding, wake surfing requires an even larger wave pattern of "surfable" quality.

Generation of sufficiently large (at least 3 feet [1 meter]), steep, surfable quality waves with a conventional ski boat is not currently possible. Even a ski boat ballasted for wakeboarding will only produce a wave of no more than about 18 inches (0.5 meter) in height. To create the maximum size wave typically involves a reduction in speed to what is technically termed the 'hull speed' (to be discussed), which in the case of a standard water ski boat is approximately 10 mph or less. At such speeds, the waves created by the boat are typically within a few feet of the boat's transom, as well as the exhaust and propeller, making wake surfing using conventional ski-boats difficult to perform, unhealthy and dangerous. At a minimum, one would prefer waves behind the boat that are sufficiently steep and concave in shape to allow the performance of advanced surfing maneuvers, e.g., bottom turns, cutbacks, floaters, aerials, tailslides, etc., at least 15 feet (5 meters) away from the boat.

In view of the limitations of existing methods, as outlined above, the invention described below is concerned with boat activated wake enhancement methods and systems that can be incorporated with conventional high speed planing boats so that, when operated at designated speeds, they produce enhanced wave patterns, suitable in various embodiments to safely serve the respective sports of wakeboarding and wake surfing.

SUMMARY OF THE INVENTION

The present invention relates to boat-activated wake enhancement methods and systems specifically designed to improve the wakeboarding and/or wake surfing quality of waves created in the wake pattern of a given boat over that observable in the absence of such enhancement. The function of the methods and systems of the present invention is to alter the wake pattern behind the boat or, more specifically, to enhance the size, shape, and distribution of waves within the wake pattern for purposes of wakeboarding and wake surfing. In contrast to conventional planing hull boats, the present invention seeks to amplify wave size at the ideal wakeboarding/surfing speeds, by altering the flow characteristics caused by the boat hull passing through the water. While conventional planing hull boats can form relatively large waves at relatively slow speeds, they cannot typically form sufficiently large waves for advanced maneuvers at preferred wakeboarding speeds. The present invention, on the other hand, is able to form wake patterns and waves of sufficient size, quality and shape, at the preferred wakeboarding speeds.

The wake enhancement system of the present invention generally comprises one or more attachments and/or extensions that are used in conjunction with the boat hull. According to the first aspect of the invention, the invention comprises a side mounted or extended wake enhancement device that can help increase lateral displacement of water, help shape the water to form better waves and help increase wave size. According to the second aspect of the invention, one or more inverted hydrofoil members are provided to help increase total displacement by the boat and therefore create larger waves. According to the third aspect of the invention, externally mounted ballasts can be used to increase weight and therefore water displacement. The subject invention's three aspects, i.e., wake enhancement devices, hydrofoil systems and external ballasts, can be combined and used together in conjunction with one another, or separately used if desired.

According to the first aspect of the present invention, a pair of substantially elongated and laterally extended protuberances or fairing sections, extending laterally outward in relation to the boat sides, preferably along both stern quarters of the boat hull, is provided. In the fore and aft direction, the protuberances preferably extend longitudinally forward to about the point of maximum chine width and then rearward to about the stern or beyond. Each protuberance is preferably secured to or otherwise extended from the boat and faired substantially to the side of the boat hull, with the bottom of each extending substantially along or close to the chine. The exterior of the protuberances is generally rounded along its length in cross section, particularly from the bottom of the hull laterally upward. The specific curvature of the protuberances can vary along most or all of its length. The protuberances can be separately mounted onto an existing boat or otherwise made an integral part of the boat hull. In plan view, the protuberances on the boat form a substantial wedge shape (or a somewhat flattened half-elliptical shape), wherein the boat's effective width is not only increased, but the point of maximum beam is shifted rearward from amidships to the stem (or in close proximity thereof). The protuberances preferably comprise the following: a bottom surface which is preferably faired with the bottom surface of the boat; a forward extending portion which is either faired with the side of the boat hull near its maximum chine width or extended outward in the manner of a hydrofoil wing or scoop; a longitudinal section generally rounded in cross section extending upward laterally from the bottom surface; and a rear section preferably terminated with a substantially squared bottom edge at or near the boat's transom. The embodiment mounted to the sides of the boat hull also comprises a mounting surface adapted to conform to the shape of the boat hull.

The configuration of the protuberances is generally designed to achieve one or more of the following advantages: 1) to help the boat displace more water to create larger waves; 2) to help cause the boat to travel deeper in the water, which also causes the boat to displace more water, resulting in larger waves; 3) to help shape and direct the water through which the boat travels so as to help minimize the resulting turbulence normally associated with displacement hull and high speed planing boats traveling at slower speeds; 4) to help displace water in a manner that causes the crest of the diverging stem waves to form far enough behind the boat to provide maneuverability and safety to the rider at the optimum wakeboarding and wake surfing speeds; and 5) to harmonize the various water effects created in the wake pattern of the boat to help create ideal waves for wakeboarding and wake surfing.

The present invention also provides increased safety to the riders in that the riders are not subjected to the dangers that are commonly associated with waves in the ocean or wave pools. For example, since the waves created by the present invention can be formed in still water, they will not be subject to rip tides. Additionally, the subject waves can be formed in water deep enough to prevent the riders from ever striking bottom, i.e., the ocean or pool floor. The present invention provides a safe, portable wake and/or wave-riding environment, that can be performed in any natural or unnatural body of water, free from natural disturbances such as wind waves, surf, currents and natural obstacles.

While many configurations are within the scope of the present invention, one or more of the following characteristics are generally found: (a) The subject protuberances preferably extend laterally outward from the stem quarter of the boat hull and therefore cause the boat's point of maximum beam to be effectively shifted rearward from amidships to at or near the stem. This helps to accelerate Bernoulli flow past the stem laterally outward and increase the size of the divergent stern waves, which in turn can contribute to forming rideable waves in the boat's wake; (b) The water effects created by the protuberances also help to amplify the waves and cause the diverging stern waves to form and crest further behind the boat. The combined shape of the boat and protuberances together, along with the continued forward movement of the boat, creates a wider and/or larger hollow behind the boat. The wider/larger hollow causes water in the wake pattern on both sides to take longer to converge, thereby causing the convergence to take place further away from the moving boat. The present invention is able to delay the convergence of the waves, focusing the wave-forming energy further back in relation to the passing boat. Moreover, the gravitational rebound cycle effects normally associated with water rising from underneath the boat to fill the hollow is also extended, which in turn can cause the resultant water effects to form further behind the boat. For these reasons, the present invention focuses the wave patterns further behind the boat than without the device to produce a V-shaped crest further astern; (c) The configuration of the protuberances can also be adapted to cause the boat to travel deeper in the water, which displaces more water to create larger waves. This is achieved by providing an inclined surface on the forward portion of the protuberances so that it travels below the boat's water line during operation or providing an internal upward flowthrough cavity which creates substantially the same effect. That is, as the protuberances of the present invention pass through water, they help to lift water up, wherein this lifting causes a reciprocal downward force to act on the protuberance. The greater downward force also causes the water line length of the boat to be greater, increasing wave length, and therefore, causing the waves to form further behind the boat.

With respect to the various water effects and interference which cause adjustments to the formation of the diverging stern waves, the present invention contemplates being able to harmonize the various motions and frequencies resulting from the various water effects, such that the resultant diverging stern waves are amplified and form relatively coherent wave shapes. In this respect, the phase relations of the various water effects, at the predetermined speeds, are preferably made to be substantially stable and/or constant with respect to each other. For example, the configuration of the protuberances which affects the lateral displacement of water, and therefore, how far back the water effects are created behind the boat, can be substantially adjusted in conjunction with the shape and position of the protuberances on the boat hull, such that the water effects caused by one adjustment are substantially in phase and/or in stable and/or in constant relation with the water effects caused by another. That is, by adjusting the width and configuration of the protuberances, and their position on the boat hull, the water effects caused by the boat and protuberances together at the desired speeds can be made to occur substantially in concert with each other, and/or at a preferred location behind the boat, such that the water effects are amplified and harmonized with one another (and do not cancel each other out), all of which help to create ideal waves and wave shapes for the sports of wakeboarding and wake surfing.

According to the second aspect of the present invention, an inverted hydrofoil system can be provided which extends downward from either the boat hull or the protuberances into the water from their respective sides or bottom. The inverted hydrofoil system of the present invention comprises one or more inverted hydrofoil-like members attached to or otherwise extended from the boat hull or protuberances, wherein the attack angle of the members can be adjusted such that the members not only travel below water level, but have an inclined surface that can lift water upward and in turn cause a reciprocal downward force to act on the boat. In this respect, the inverted hydrofoil members help to apply a downward force on the boat or protuberance during use to further increase water displacement and therefore increase wave size.

When a single hydrofoil member is used, the member is preferably connected to a strut extending downward from below the boat hull at about amidships. When dual hydrofoil members are used, the members are preferably extended downward into the water from the sides of the boat near the maximum chine width or downward from the protuberances on the stem quarter of the boat, wherein the depth of the members in the water and angle of attack can be adjusted. The function of the adjustments is to increase wave size and alter wave shape within the wake pattern by dynamically controlling the boat's attitude and displacement while under way. By placing the hydrofoil members near the maximum chine width, the downward pressure exerted on the boat helps to cause the entire boat, not just the stem, to travel deeper in the water. Lowering the entire boat (and not just the stern) results in an increased waterline length which in turn results in a longer wave length, which advantageously stretches out the formation of the entire wake pattern away from the boat. The hydrofoil member(s) can be provided on the bottom or sides of the boat hull, and can be provided independently from or together with the protuberances. When provided with the protuberances, the hydrofoil members can be made integrally with the protuberances or provided as separate members that extend from the boat hull.

The third aspect of the present invention relates to one or more ballasts for increasing the weight of the boat and therefore displacement. The protuberances themselves can be made hollow and self-ballasting with inlet and outlet openings to allow water to enter during the boat's operation. The protuberance can be filled by a small pump, for example, and when the desired level is reached, the protuberance can be plugged and the water maintained inside. Alternatively, ballasts capable of allowing water to enter and exit without having to use pumps or valves are contemplated. Pressure applied by water as the boat moves forward can force water into the protuberances (or other ballasts provided on the boat connected to the protuberances) to increase weight. When pressure is eliminated, such as when the boat stops, water can drain automatically, thereby reducing weight.

An additional feature of the subject invention is the placement of large intake ducts at the front of the protuberances with correspondingly large outlet ducts at the rear. The oversized intakes permit an internal flow of water within the protuberances which travels relatively upward, from the low inlet opening to the higher outlet opening, to create a reciprocal downward force on the boat to drive the boat deeper in the water. An inlet gate can also be provided whereby the inlet into the protuberance is restricted on start-up until the boat commences to plane, whereupon the inlet is opened and ballast is added to the protuberance. This latter method will enable ballasting of the boat in excess of its deadload start power capacity, and can result in a commensurate increase in wave height.

While the embodiments disclosed herein are ideally suited to perform in the intended manner, it is well understood that many other embodiments are possible which can provide one or more of the advantages described herein. The present invention contemplates various wake enhancement methods and systems generally defined by their ability to help increase the displacement of water naturally caused by the boat, using a form of constructive interference, which helps to create waves and wake patterns that are better suited for performing wakeboarding and/or wake surfing maneuvers.

BRIEF DESCRIPTION OF THE DRAWINGS

FIG. 1 shows a perspective view of the boat with an embodiment of the wake enhancement device attached to or otherwise extended from the boat hull;

FIG. 2*a* shows a top view of the boat with an embodiment of the wake enhancement device attached to both sides of the boat;

FIG. 2*b* shows a bottom view of the boat with an embodiment of the wake enhancement device attached to both sides of the boat;

FIG. 3 shows a rear view of the boat with an embodiment of the wake enhancement device attached to both sides of the boat;

FIG. 9(*b*) is a sectional view of the wave pattern shown in FIG. 9(*a*), taken along the broken line 5—5;

FIG. 10(*b*) is a sectional view of the wave pattern shown in FIG. 10(*a*), taken along the broken line 6—6;

FIG. 13(*b*) is a sectional view of the wave pattern shown in FIG. 13(*a*), taken along the broken line 9—9;

FIG. 14(*b*) is a sectional view of the wave pattern shown in FIG. 14(*a*), taken along the broken line 10—10;

DETAILED DESCRIPTION OF THE INVENTION

Figure 4A:
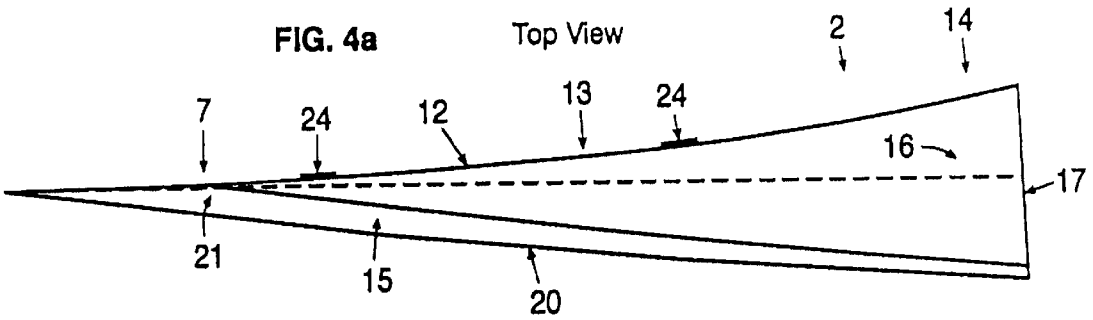
FIGS. 4*a*, 4*b*, 4*c* and 4*d* show a top view, back end view, forward-top-side perspective view and rear isometric view, respectively, of an embodiment of the wake enhancement device of the present invention.

General Wake Formation Principles:

Waves formed in wake patterns behind a boat are created by the effect of gravity on the displacement of water caused by the boat's hull moving through water. A series of complex motions in the water are typically created by the boat's hull as it displaces water, which collectively help to form various wave formations. When using an ordinary planing hull boat, the effect of gravity on water displaced by the hull can cause various harmonic motions and water effects to occur. For example, a wave termed a "primary bow wave" is formed by the bow of the boat's hull as it travels through the water. Energy from the bow's movement is imparted to the water, causing water to be displaced under and away from the boat, forming a bow wave that spreads outwardly behind the boat as it passes on. Because energy is imparted to the water by the bow, which has a relatively complex shape in relation to the water surface, the primary bow wave is actually an envelope of water comprising many coherent waves. When the phase relations of the coherent waves are substantially stable and constant, the primary bow wave forms a relatively coherent wave shape. A depression is also formed which spreads outwardly behind the primary bow wave. The depression is a natural side-effect of the primary bow wave's first wave-cycle, and is created by the restoring force of gravity which causes the first wave cycle to subside, and, as with all wave cycles, after the depression subsides, the water level rises again to form the second wave cycle, and so on.

"Diverging stem waves" are also created by water displacement caused by the boat's hull moving through water, and in particular, by the pressure differential created between the water displaced (that builds up on the sides of the boat) and the area displaced (the "hollow" or cavity created immediately behind the boat). This pressure differential naturally causes the water that builds up on both sides of the boat to converge into the hollow due to the restoring force of gravity. When the differential is great enough, the restoring forces can cause water converging from both sides of the hollow to overshoot the equilibrium point, causing it to rebound, and form an "eruption" or peak that raises the water level on both sides to form a V-shaped crest. Accordingly, the diverging stem waves spread outwardly behind the boat in a V shape, and in a manner that has sloped and angular components which can, in ideal circumstances, allow wakeboarding and/or wake surfing maneuvers to be performed thereon.

The size of the diverging stern waves is affected by ripple effects caused by the boat termed "transverse body waves."

Transverse body waves, which are transverse to the direction of the boat's travel, are essentially ripples in the water caused by the moving boat. The first of the transverse waves contributes to the size and/or height of the diverging stern waves due to constructive interference. That is, the first transverse wave constructively interferes with and augments the diverging stem wave and provides an additional lift component that helps to raise the level of the V-shaped crest. Also, the natural side-effect of the first transverse body wave is the creation of additional wave cycles that form over a distance. As additional transverse body waves form further behind the boat, they continue to encounter the further astern portions of the spreading diverging stem waves. Such encounters can cause hydraulic jumps to occur at the points of interference, which in turn cause the waves to spill over and curl forward.

With respect to conventional planing hull boats, the speed at which the largest diverging stern waves are formed is known as the "hull speed." The hull speed is the speed at which the maximum wavemaking drag condition of the boat is reached, and the troughs of the bow and stem waves coincide. Unfortunately, however, the hull speed of most conventional planing hull boats is too slow for performing advanced wakeboarding maneuvers. A conventional planing boat's hull speed is typically about 5 to 10 miles (8 to 16 km) per hour, while the ideal speed for performing advanced wakeboarding maneuvers is between 18 to 24 miles (29 to 39 km) per hour, with the preferred range being about 20 to 21 miles (32 to 34 km) per hour. Accordingly, the ideal speeds for performing wakeboarding maneuvers for most conventional ski boats do not coincide with the speeds at which the largest waves are formed, thereby making advanced wakeboarding maneuvers on large size waves difficult to achieve.

Conventional high speed planing boats are designed to travel at preferred water skiing speeds of between 24 to 50 miles (39 to 80 km) per hour. Water skiing speeds vary somewhat depending on the types of maneuvers that are performed, i.e., the desired speed can range from about 24 to 35 miles (39 to 56 km) per hour for ski jumping; about 28 to 36 miles (45 to 58 km) per hour for competition slaloms; and about 40 to 50 miles (64 to 80 km) per hour for barefoot skiing. At these speeds, conventional boats are designed to ride-up-on and plane over water to minimize water displacement and drag. Further, the hull is designed to reduce it's effects on water, i.e., reduce the size of the waves and wake patterns created by the boat. Likewise, at ideal wakeboarding speeds, i.e., 18 to 24 miles (29 to 39 km), per hour, conventional boats similarly plane over and lift out of the water, which in turn causes the boat to displace less water. And, since wave amplitude is a function of water displacement, the waves created by conventional planing hull boats traveling at ideal wakeboarding speeds (unaltered by increased ballast) are typically too small. Again, wakes that are too small are undesirable for advanced wakeboarding maneuvers.

Moreover, because wave length is a function of the speed of the boat (wave length equals boat velocity squared times two pi divided by acceleration due to gravity), how far behind the boat the diverging stem waves form is partly a function of the boat's speed. Therefore, when a conventional planing hull boat travels at its hull speed, the crest of the diverging stern waves forms very close behind the boat, e.g., as little as 7 to 15 feet. This is too close for wake boarders who require distances behind the boat of between 35 to 70 feet (the ideal distance for beginners being about 35 to 45 feet, and for advanced riders being about 55 to 70 feet).

For all of the reasons discussed above, conventional ski boats are not optimally designed to form sufficiently large enough waves that form far enough behind the boat to enable advanced wakeboarding maneuvers to be performed at the ideal wakeboarding speeds.

The Wake Enhancement Device of the Present Invention:

Several embodiments of the present invention are summarized below. FIGS. 1–3 generally show the present wake enhancement protuberance or fairing embodiment, generally termed device 2, attached to or otherwise extended from a typical planing hull speed boat 1. The device 2 preferably extends laterally from the boat hull 3 along the lower stem quarter of the boat side walls. The device extends longitudinally in the fore and aft direction from about the maximum chine width 11, shown in FIG. 2*b*, to about the stem 8, shown in FIG. 2*a*. Although two protuberances are generally provided, one on the port side 5, and one on the starboard side 6, for ease of description, only one side will generally be discussed.

The device 2 is capable of being mounted directly onto an existing boat, or integrally formed with the boat hull 3. The device 2 has a forward end 7 which widens through a midsection 13 to a wider back end 14. The back end 14 terminates with a surface 17 at or near the transom 8. In general, as seen in FIGS. 4*a*–4*d*, the device 2 has four contiguous surfaces: the inside mounting surface 12 (when needed) which engages the side walls 4; a terminating surface 17 on the back end 14; an elongated rounded surface 15 extending longitudinally in the fore and aft direction from the forward end 7 to the back end 14; and an upper surface 16. Additional detail regarding FIGS. 4*a*–4*d* will follow in the next section.

Figures 5, 6, 7, 8:
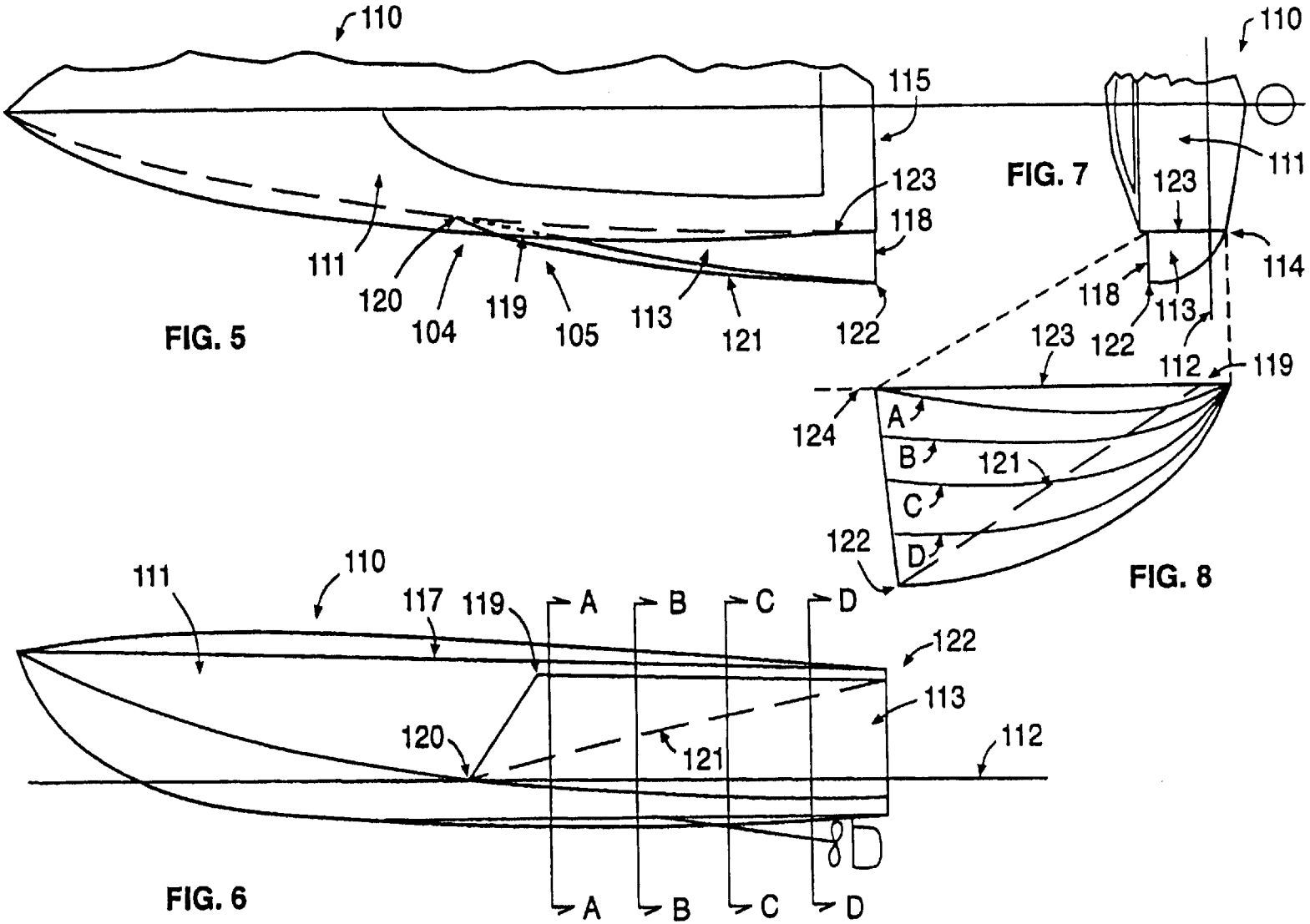
FIG. 5 is a top view of the left half of a conventional water ski boat, showing one embodiment of the wake enhancement device of the present invention affixed to the left stem quarter of the boat.
FIG. 6 is a left-side elevation of the boat with the same embodiment of the wake enhancement device of the present invention shown in FIG. 5 mounted thereto.
FIG. 7 is a stem view of the left half of the boat showing the back end of the same embodiment of the present invention shown in FIGS. 5 and 6.
FIG. 8 is an expanded view of the same embodiment of the present invention shown in FIG. 6 showing lateral section profiles shown at stations A—A through D—D.

Referring now to FIGS. 5, 6, 7 and 8 of the drawings, there are three orthogonal views of a conventional water-ski boat 111, at rest in still water 112, and the wake enhancement device of the present invention, comprising longitudinally extended protuberances or fairing sections 113. A mirror-image of the device (not shown) is similarly mounted upon the opposite right stem quarter of the boat. As with the previous discussion, the protuberance 113 extends longitudinally from a forward point 104 near the widest breadth 105 of the boat's chine 114 to about the boat's stem 115, or transom, and vertically from the boat's chine 114 upward in a curved manner. The transverse thickness of the protuberance 113 varies along its length and vertical height, as illustrated in FIG. 8, which shows enlarged sectional profiles of varying thickness normal to the boat's side as a function of vertical distance above the boat's chine at stations A—A through D—D, shown in FIG. 6, and at the stem, shown in FIG. 7. The thickness profiles can be summarized as follows:

The profile at the stem 118 is preferably the widest. The other profiles preferably become progressively narrower toward the forward end 104, which is faired smoothly into the side of the boat. All profiles preferably have a zero width at the bottom, where they are faired smoothly into the boat's bottom at the chine 114. Also, all profiles are preferably smoothly curved, convex outwards, with their points of maximum width falling along a "tangent" line 121, visible in FIG. 6, which is the lateral-most edge of the protuberance, running from near the lower forward corner 120 to its top rearward comer 122. The tangent line 121 may be straight or slightly curved, depending upon the design of a particular boat. The forward end 104 is preferably faired to the side of the boat and slopes up rearward from bottom 120 to top 119, as shown in FIG. 6, (although a forward slope or neutral position is workable). In the embodiment that is mounted to the boat, the inside edges 123 of the profiles are shaped to match corresponding exterior section profiles of the boat's side, so that the entire protuberance fits snugly to the boat, whatever the shape of their common area of contact.

In plan view, FIG. 5, the tangent line 121 preferably has a convex curve and progressively becomes more parallel (to the centerline of the boat) near the stem. This curve helps direct water laterally outward and rearward. Although simple shapes, such as simple cylinders, flattened cones, triangular wedges, etc., are all within the contemplation of the present invention, the preferred curvature and rounded surface discussed above help the protuberances perform in the intended manner.

Figure 9:
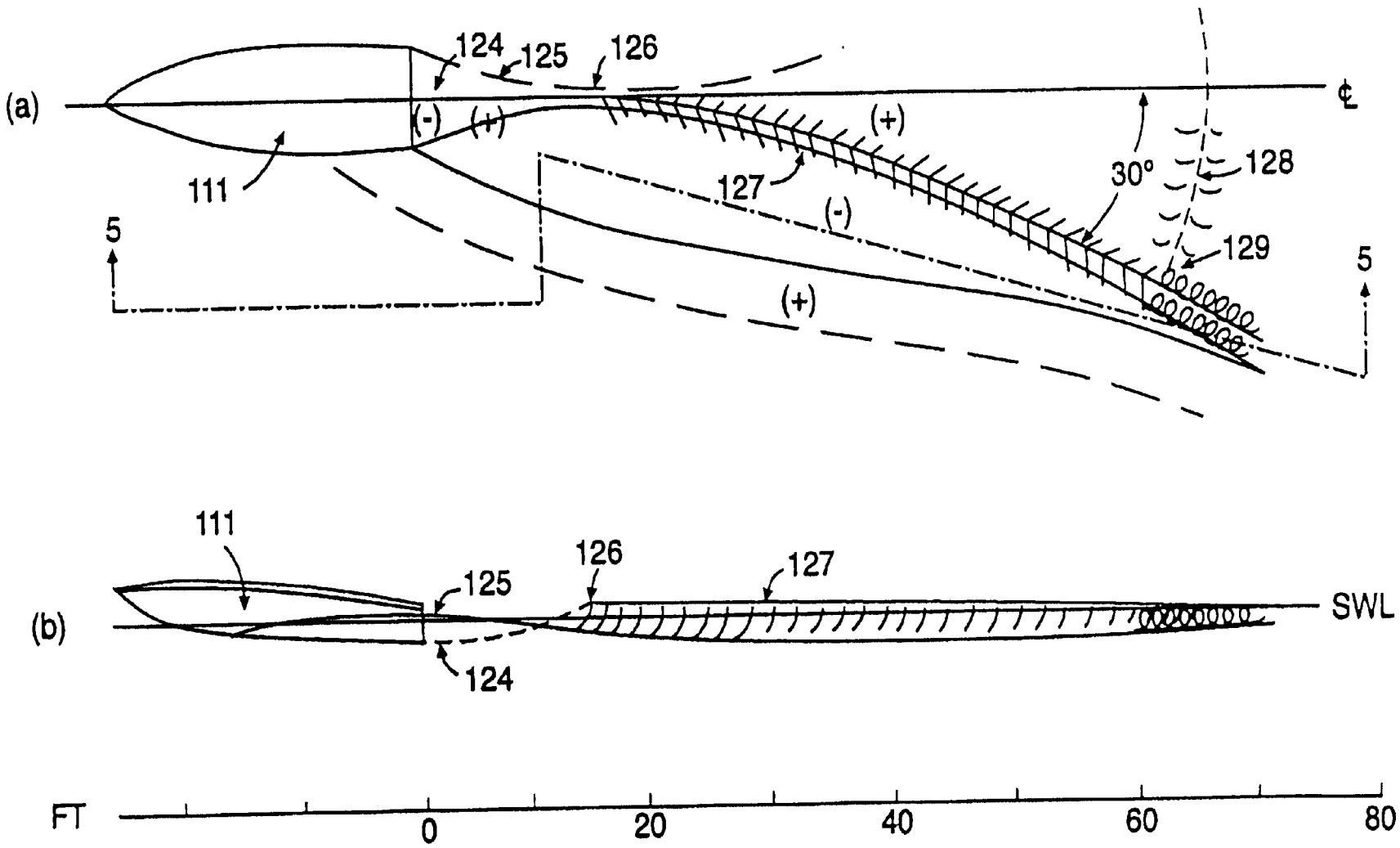
FIG. 9(*a*) is a top view of one side of the wave pattern generated by a conventional water-ski boat, as shown in FIG. 5, without any wake-enhancement devices attached, operating at the preferred wake-boarding speed of about twenty miles per hour.

FIG. 9 shows top (a) and sectional (b) views of the wake produced by the boat 111, without the wake-enhancement device 2, operating in a semi-planing mode at a reduced speed of about twenty miles (32 km) per hour, considered optimum for wake boarding. Plus (+) and minus (−) signs in these figures indicate areas of the wake that are above or below the undisturbed water level, respectively.

The wake is characterized by a V-shaped hollow 124 behind the boat's transom, bounded by a pair of ridges 125, which are produced by lateral acceleration of water displaced by the moving boat. Behind the transom, the wave ridges converge inward to a common peak 126, comprising the highest elevation of the wave pattern, behind which the peak splits into two diverging waves 127, each making a half-angle of a predetermined amount, i.e., in this case about thirty degrees, from the pattem's axis of symmetry. Further behind the transom, the diverging waves intersect the second transverse body wave 128 produced by the moving boat and commence breaking 129. The two diverging waves and their intersection with subsequent transverse body waves comprise the characteristic ship-wake pattern, which is well known and will not be discussed further. The steep crests of the diverging waves between the central peak 126 and their point(s) of breaking 129 form the launch and landing ramps for the sport of wake boarding, as well as the wave riding formation for the sport of wake surfing. The enhancement of the shape, height and crest length of these waves, and their distance from the boat's transom, are primary objectives of the present invention.

Figure 10:
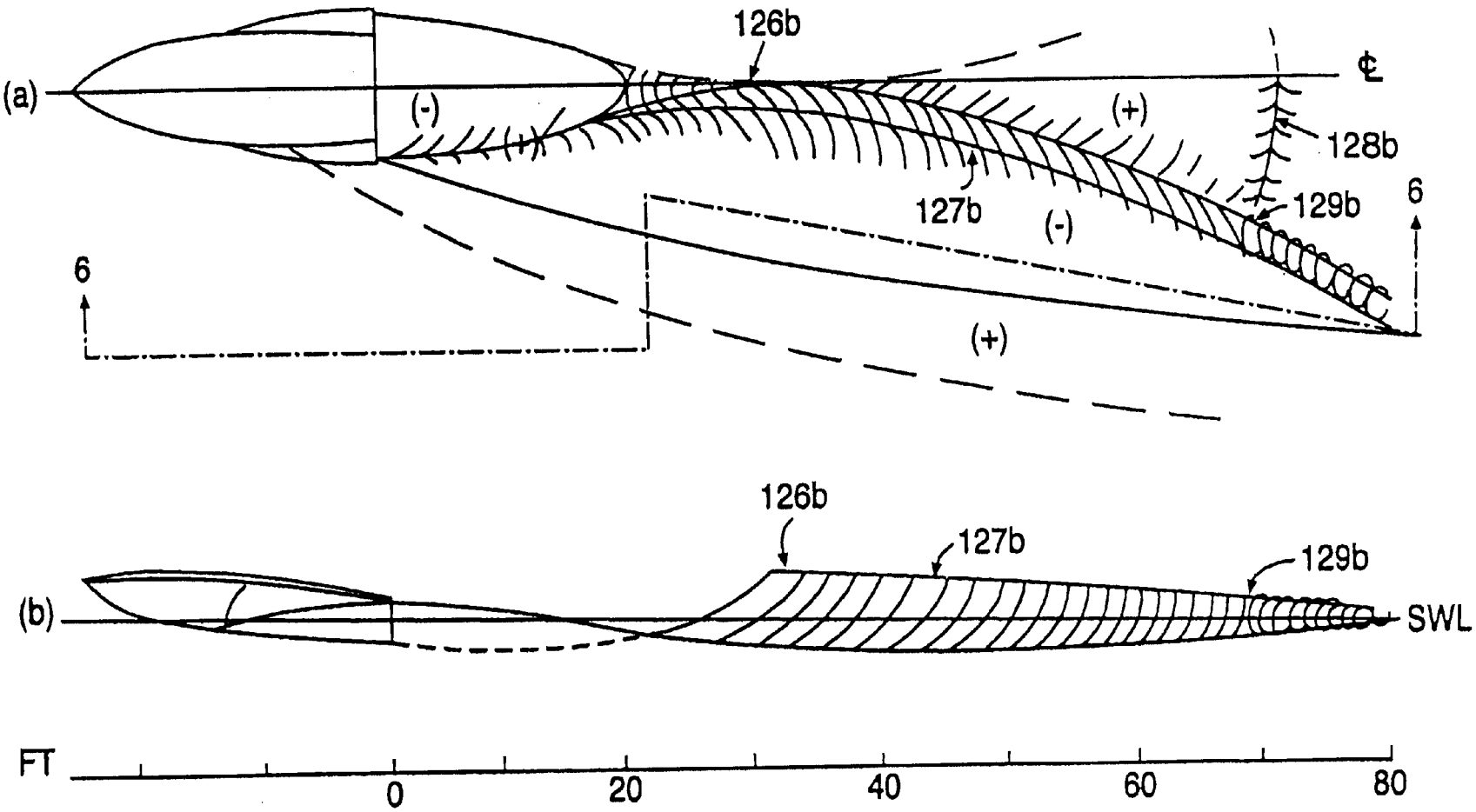
FIG. 10(*a*) is a top view of one side of the wave pattern similar to that of FIG. 9(*a*), but created by the boat equipped with the wake-enhancement device of the present invention, operating at the preferred wake-boarding speed of about twenty miles per hour.

FIGS. 10(*a*) and 10(*b*) are similar to FIGS. 9(*a*) and 9(*b*), respectively, except that the boat is now equipped with the wake-enhancement device 2 described above. The following differences in the wake characteristics, derived from photographs of scaled model tests, indicate that the following objectives of the wake-boarding embodiment have been achieved: First, the central peak 126*b* is higher than peak 126 for the same boat without the wake-enhancement device, and is located further behind the boat's transom. Second, the crest height 127*b* of the diverging waves is higher than the diverging waves created by the boat alone, and breaking 129*b* commences further back from the boat's transom. Third, the transitional radius from the trough of the wave to its crest is larger, along the entire wave front commencing at the central peak 126*b* to the break point 129*b*. The shape of this radius is preferred by wakeboarders in that it provides a bigger transition, which serves as a superior launching and landing platform for wake performed maneuvers. Furthermore, in the preferred ride area, the top edge of the wave crest is not a crumbly peak, but is solidly supported by a full triangular tabletop of water that lies between the two diverging waves.

Figure 11:
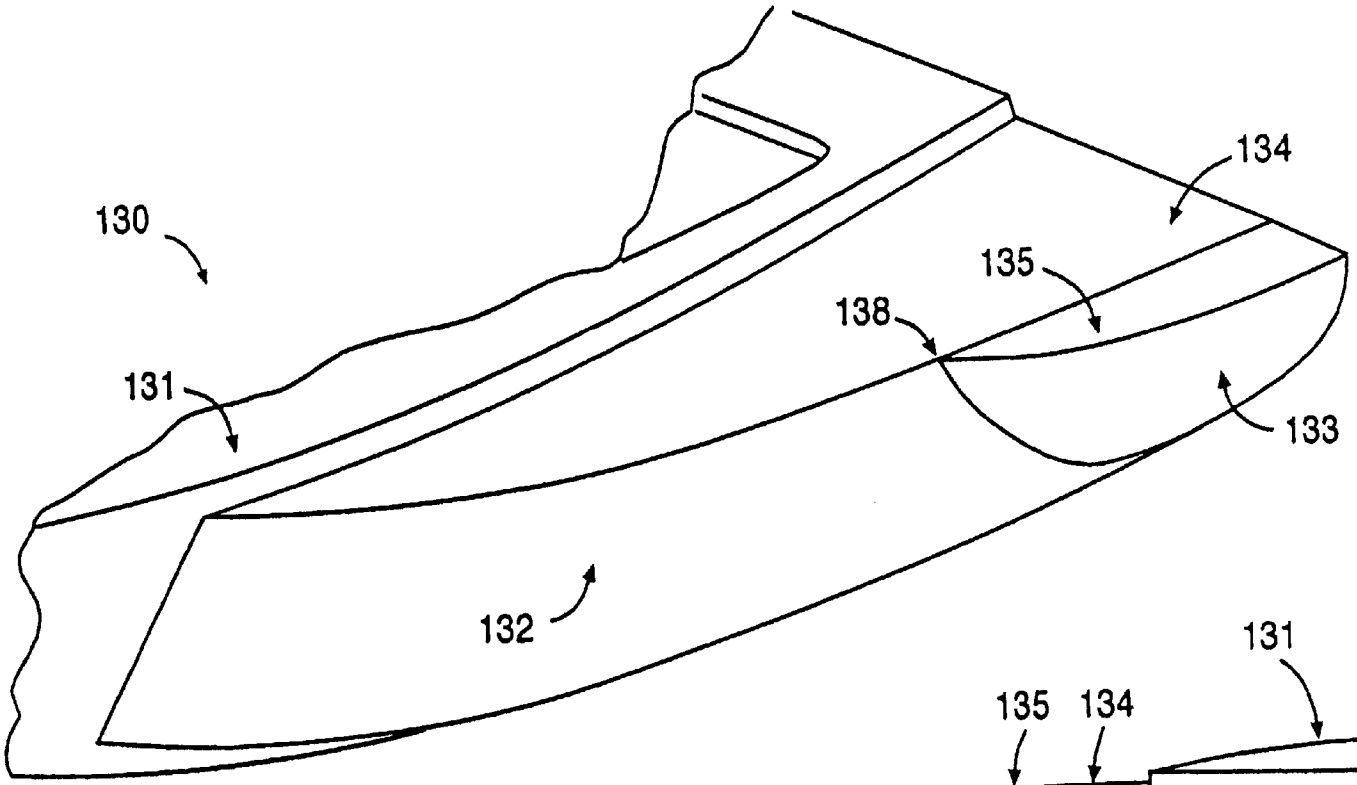
FIG. 11 is a rearward and downward perspective view of the boat shown in FIG. 5, but with an alternate wake surfing embodiment of the present invention affixed to the left stern quarter of the boat's hull.

Referring now to FIG. 11 of the drawings, shown is a rearward and downward perspective of a cutaway segment of a conventional ski-boat hull 131, similar to that shown in FIGS. 5–8 by numeral 111, and showing a wake-surfing embodiment of the present invention, comprising an alternative primary protuberance 132 mounted exteriorly upon the left stern quarter of the boat. A mirror image (not shown) of said primary protuberance is similarly mounted on the right stem quarter of the boat. The primary protuberance is similar to that shown as numeral 113 of FIGS. 5–8, except for an optional secondary protuberance or extension 133, shown mounted exteriorly—or otherwise made an integral part of—the primary protuberance, preferably positioned so that their top surfaces 134 and 135 are substantially coplanar, or otherwise flush, as well as their back ends 136 and 137.

The secondary protuberance 133 is only partially as long as the primary protuberance, to which it is snugly contoured at all points of their common interface. The forward end 138 of the secondary protuberance, shaped somewhat like a boat's bow, makes a predetermined angle, i.e., preferably about thirty degrees, with the side of the primary protuberance. All transverse profile sections of the secondary protuberance 133 are convex outward, and preferably increase in width smoothly from the forward end 138 toward the stem, wherein the secondary protuberance 133 has a top sectional width 135 that is less than the corresponding width of the primary protuberance 132.

Figure 13:
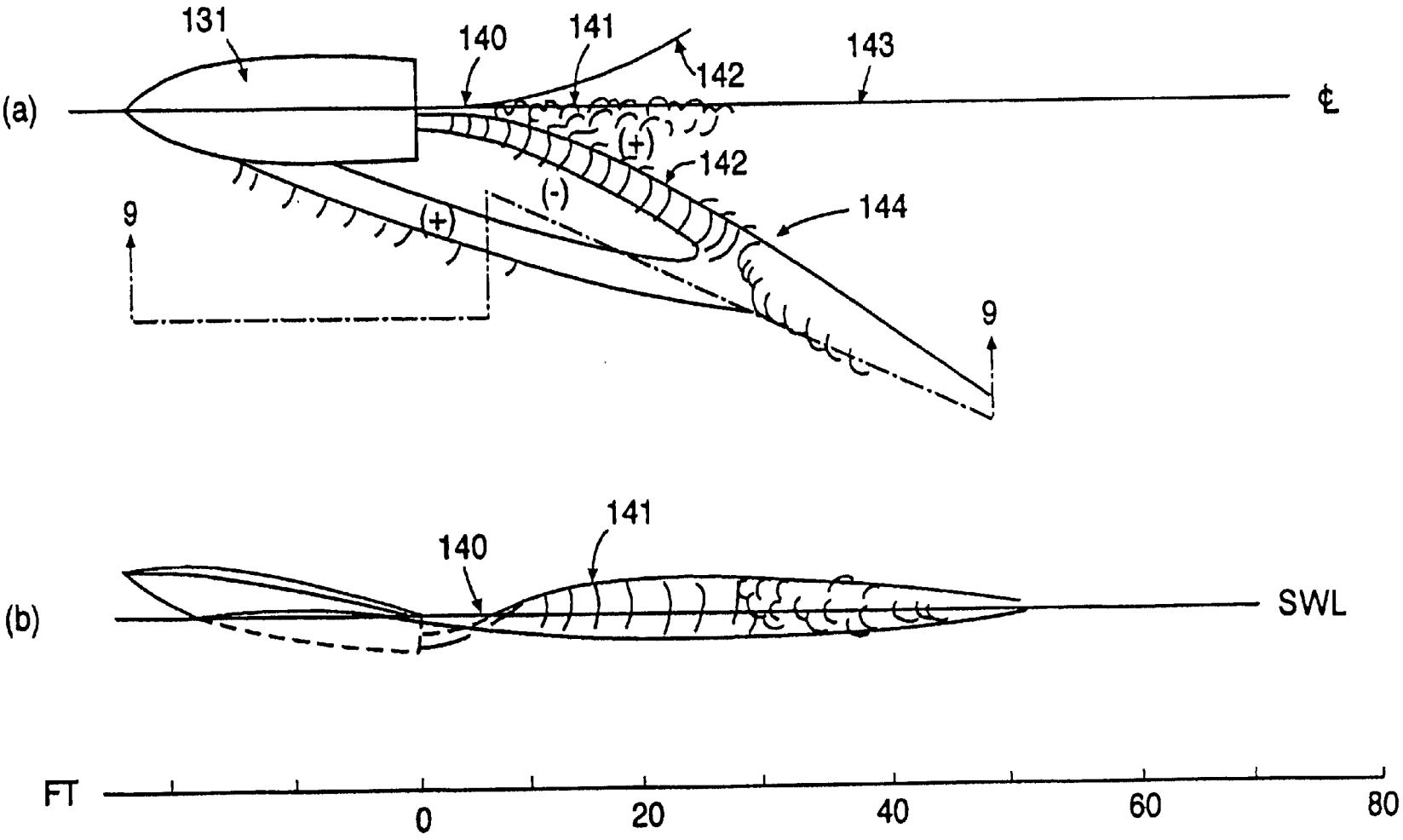
FIG. 13(*a*) is a top view of one side of the wave pattern generated by the conventional water-ski boat of FIG. 5, without any wake-enhancement device attached, operating at the preferred wake-surfing speed of about ten miles per hour.

FIG. 13 shows top (a) and sectional (b) views of the wake produced by the aforesaid boat 131, without the present invention attached, operating in a semi-displacement mode at a further-reduced speed of about ten miles per hour. In this mode, most of the engine power is expended in making waves. In contrast to the wake pattern of FIG. 9, the flow-induced cavity behind the transom is replaced by a convergent ridge 140, which rises to a central—but higher—peak 141 behind the transom. The triangular peak 141 is bordered by two steep, hollow, divergent stem waves 142 making, again, a predetermined angle with the wake axis 143. Each divergent wave curls over and breaks 144 at a predetermined distance behind the transom. The divergent waves are marginally suitable for wake surfing because of their minimal height, short crest length, and close proximity to the boat transom.

Figure 14:
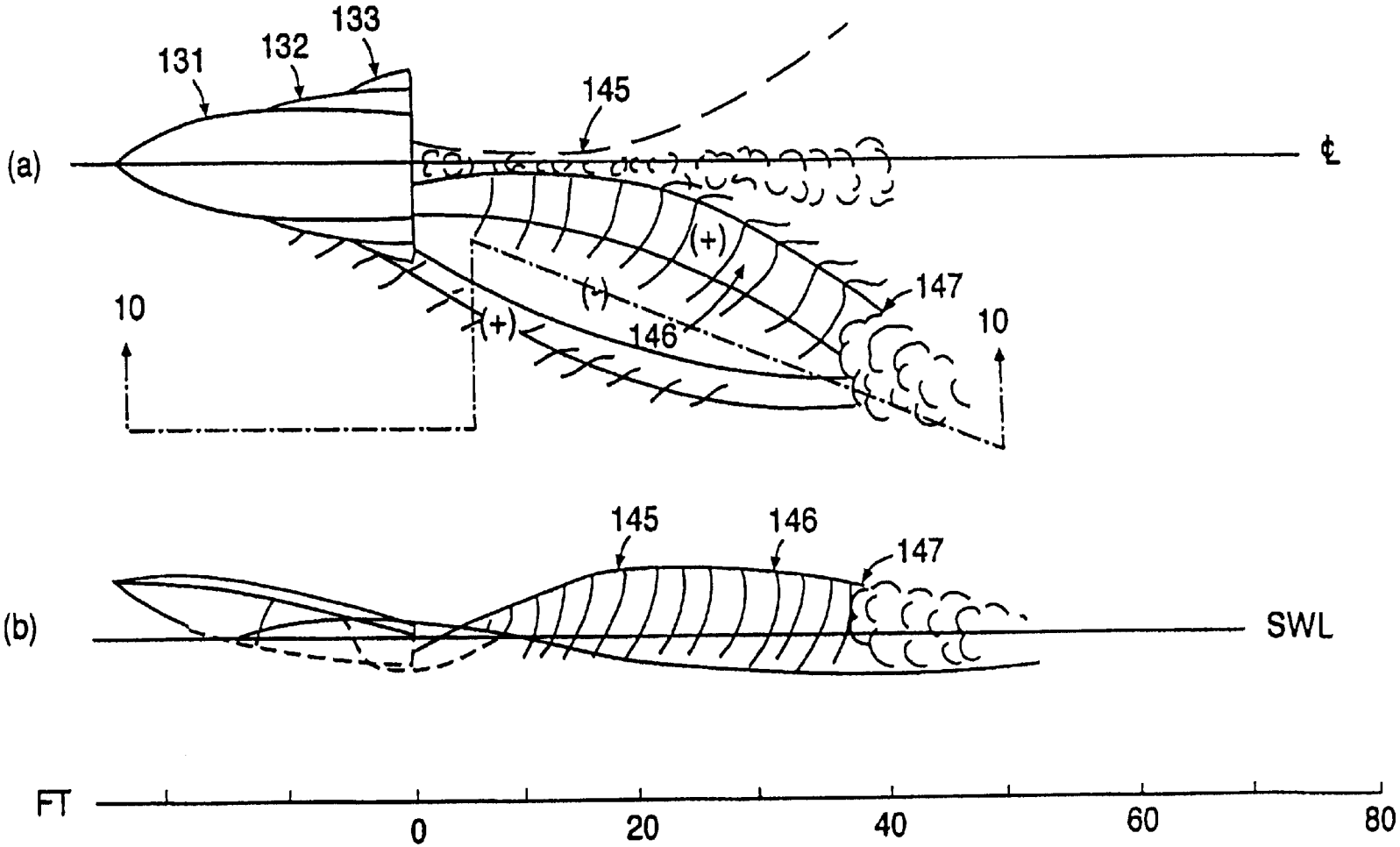
FIG. 14(*a*) shows a top view of one side of the wave pattern similar to that of FIG. 13(*a*), but created by the boat equipped with the alternate wake surfing embodiment of the present invention shown in FIG. 11, operating at the preferred wake-surfing speed of about ten miles per hour.

FIGS. 14(*a*) and 14(*b*) are similar to FIGS. 13(*a*) and 13(*b*), respectively, except that the boat 131 is now equipped with the above-described wake-surfing embodiment of the wake-enhancement device 132 and 133. The following differences between their respective wake characteristics are evident: Although the central peak 145 occurs at about the same distance behind the transom, it is considerably higher than the wave formed by the unconfigured boat. The steep, hollow crest face 146 of the diverging waves now extends further from the transom before breaking 147, providing extra crest length for wave surfing. Additionally, the transitional radius from the base of the wave to its crest is larger and more conducive for surfing maneuvers.

Additional Detail Regarding the Wake Enhancement Embodiment:

The terminating surface 17 of the device, as shown in FIGS. 2*a*–2*b*, 3, 4*a* and 4*b*, is preferably planar, although not necessarily so. The configuration of the surface 17 by itself is not significant. What can affect performance, however, is the hard edge 18 on the outer and lower-most transverse portion of the stem, which preferably forms a bluff or squared comer with the sides and bottom of the device. The hard edge 18 helps to provide a clean separation of water from the device in the desired rearward direction, unlike a chamfered or rounded edge, which causes water to wrap around the back end 14 and can induce undesirable vortices, as determined by testing and observation.

Figure 4C:
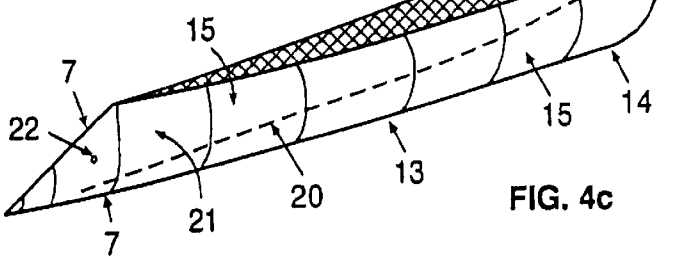
Figure 4B:
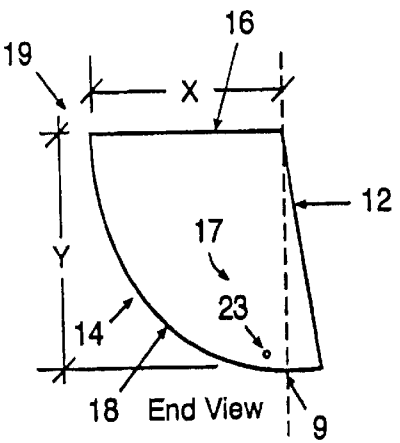

The rounded surface 15 that extends around the sides of the device forms an outside edge preferably shaped in cross-section as substantially shown in FIG. 4*b*. That is, the outside edge is curved and preferably in the shape of a segment of a circle, or arc, and therefore, can be defined in terms of its radius. The arc begins at the bottom surface 9, and then extends gradually laterally outward and upward to almost vertical at the top 19.

An approach that can be followed to determine a workable radius for any given type of boat is provided as follows: First, the boat is tested without the device attached at preferred wakeboarding speeds; Second, at the preferred speeds, the draft, or depth of the water in relation to the bottom of the boat at the chine, is measured; and Third, once the draft is measured, that dimension is multiplied by a predetermined factor. The predetermined factor is preferably about five for wakeboarding purposes and can range from as little as one to as high as twenty or more, depending on the circumstances. For example, if the draft at the chine with the boat traveling at 20 mph is about 4 inches, the ideal radius for the terminating surface 17 of the device may be about 20 inches.

The size of the radius substantially determines how far laterally outward the back end 14 of the device extends from the sidewalls 4 of the boat. Accordingly, the radius also determines to a significant extent the maximum beam width at or near the stem, and therefore, the extent to which the device displaces water laterally outward. Of course, the curvature of the rounded surface 15 at the back end can vary from a constant radius. FIG. 4*b* shows dimensions X and Y which can vary depending on whether the radius is open or closed. When the radius is open, X is greater than Y; when the radius is closed, Y is greater than X. The present invention also contemplates the use of curves of varying degrees, and complex configurations. The radius is preferably only used as a unit of measurement to approximate the size and shape of the rounded surface 15 at the back end 14.

The performance of the device in its ability to reduce turbulence can be affected by the degree to which the rounded surface 15 is rounded or extends laterally outward in a rounded manner up the lateral sides of the device. In this respect, the rounded surface 15 near the back end maintains adjacent water support and foundation at the point of separation, which in turn, allows the water that transitions rearward along the sides of the boat to transition smoothly into the hollow, i.e., with little or no collapsing turbulence, thereby forming relatively smooth wake patterns and waves. A smooth transition avoids energy loss due to friction/turbulence and permits a concentration of wave force. With ordinary boats, particularly where the chine is squared, the water that transitions rearward into the hollow typically collapses abruptly due to the lack of adjacent water support and foundation. This abrupt collapse, which spills into the hollow and creates additional turbulence in the form of bubbles, vortices, cavitations, chums, boils, white water, etc., not only disturbs the water surface, but can lead to a dispersion of wake energy, which can in turn adversely affect the quality and size of the waves and/or wake patterns.

Figure 12:
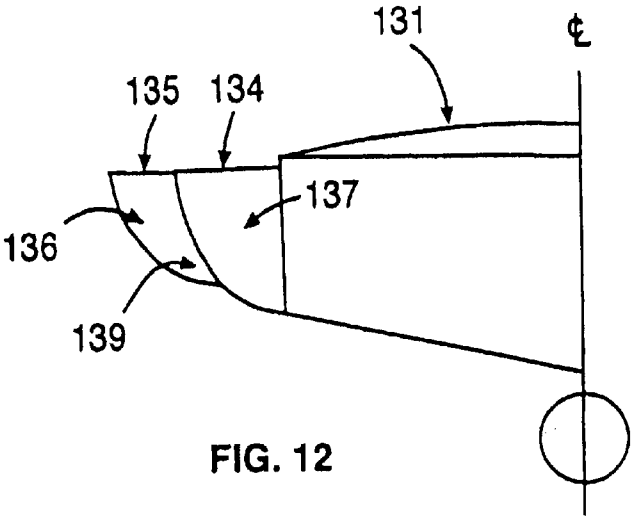
FIG. 12 is a rear view of the left half of the boat shown in FIG. 11, showing the back end of the alternate wake surfing embodiment.

Furthermore, as shown by testing and observation, a square chine boat tends to create a wake commencing at the central peak 126*b* to the break point 129*b*) that: (a) has relatively tight transition from trough to crest—which is difficult to launch from, attain height in jump, and land successfully upon; and, (b) has a wave crest that is peaky, i.e., tends to crumble when hit by the wakeboard and does not provide a solid foundation to launch from. In contrast, the subject invention's broad and rounded cross-section, as shown in FIG. 4*b* and FIG. 12, creates a wake: (a) with a significantly larger transition from trough to crest, (thus, easier to launch from, attain high air and land successfully upon) and (b) has a solidly supported crest that is not peaky and does not crumble or give way when hit by the wakeboard upon launching.

Figure 4D:
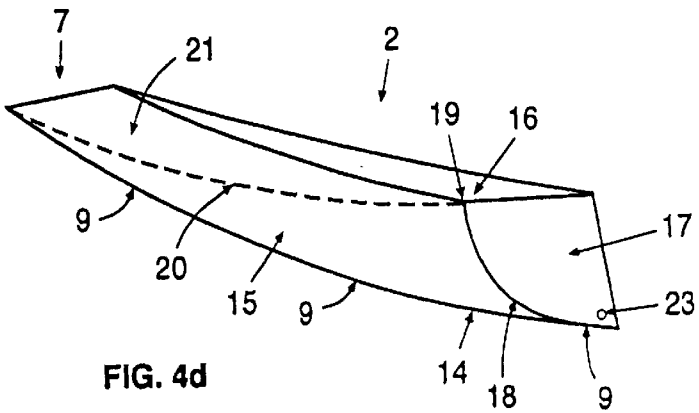

Shown in FIGS. 4*c* and 4*d* is a tangent line 20, like the one shown in FIG. 6, which is essentially a line that represents the outer-most lateral extension of the rounded surface 15, and preferably extends from a low point on the front portion 7 to a high point 19 on the back end 14. When viewed from above, therefore, only the portion of the rounded surface 15 above the tangent line 20 can be seen, and, when viewed from below, only the portion of the rounded surface 15 below the tangent line can be seen. The areas above and below the line are curved inwardly toward the top and bottom of the device, respectively, wherein the area below the line is preferably faired with the boat's bottom surface, and the area above the line is faired into the side walls 4 or terminates at upper surface 16.

An inclined area 21 is preferably provided above the tangent line 20 on the front portion 7 of the rounded surface 15, wherein the slope of the inclined area 21 is partially affected by the slope of the tangent line 20. The inclined area 21 is preferably adapted such that its forward end is submerged in water. That is, the device 2 is positioned on the sidewalls 4 in a manner that results in a portion of the forward end 7 traveling below water level during operation. In this manner, the inclined area 21 helps push water that builds up on the sides of the boat upward, which in turn creates a reciprocal downward force on the device. And, because the front portion 7 of the device 2 is located near the widest point 11 of the boat hull or amidships, this downward force can help to cause the entire boat to travel deeper in the water, which results in greater water displacement, and therefore, larger waves.

Traditional boat design incorporates, in plan view, a continuously foiled template shape that starts at a narrow bow, widens to about the boat's mid-point and then re-narrows at the boat's stern. The reason for re-narrowing the stern is for the purpose of pressure recovery and reduction of drag on the boat. The present invention, on the other hand, has a plan view shape which does not seek pressure recovery, but instead seeks the opposite, i.e., increased wavemaking drag. Accordingly, not only is the effective width of the boat hull widened at the chine, but also the widest point of the chine is moved rearward substantially to the stern, substantially eliminating pressure recovery.

In this respect, the device 2 is preferably faired into the sidewalls 4 and widened from a narrow front portion 7 to a relatively wide back end 14. The front portion 7, as shown in FIGS. 2*a* and 2*b*, extends outward at an angle from the sidewalls 4, wherein the degree of the angle in relation to the sidewalls 4 can vary. For wake enhancement, the angle, when viewed from above, preferably ranges from almost zero to about 20 degrees, with the preferred range being about 10 to 15 degrees. For wake surfing, however, the angle is preferably greater, ranging from about 20 to 40 degrees, the preferred range being about 25 to 30 degrees. The actual angle will depend on the desired effects and the power and shape of the boat being used.

The wake enhancement device of the present invention can be made larger, for purposes of creating surfing waves, rather than merely enhanced wakes. This embodiment 132 is, as shown in FIGS. 11 and 12, substantially similar to the wake enhancement embodiment, in that it has: a mounting surface (when needed); a back end surface; an elongated, rounded surface; and an upper surface. It is also attached to the stern quarter of the boat hull, behind the widest point, such that it extends below the water line. It can also be constructed in substantially the same manner, using the same materials. The larger device 132 can also be mounted in the same manner on virtually the same kind of boats, or integrally formed therewith.

The main difference is that the overall radius, and the dimensions, surfaces and curvatures, are bigger. For example, the radius of the back end of the device is considerably larger. Using the same formula discussed in relation to the previous wake enhancement embodiment, the factor multiplied by the draft is more on the scale of about ten or more, rather than five. Accordingly, if the draft is 4 inches, the radius would be more like 40 inches. Due to the larger radius, all of the surfaces and curvatures are larger. For example, as mentioned above, the angle at which the forward portion of the device extends outward in relation to the sidewalls in plan view is substantially greater. The effective width of the back end of the boat is also substantially increased, as well as the size of the rounded surface 15. While the tangent line 20 extends in substantially the same manner, because the back end is larger and higher, the tangent line 20 in this embodiment is also likely to be steeper.

Figure 21:
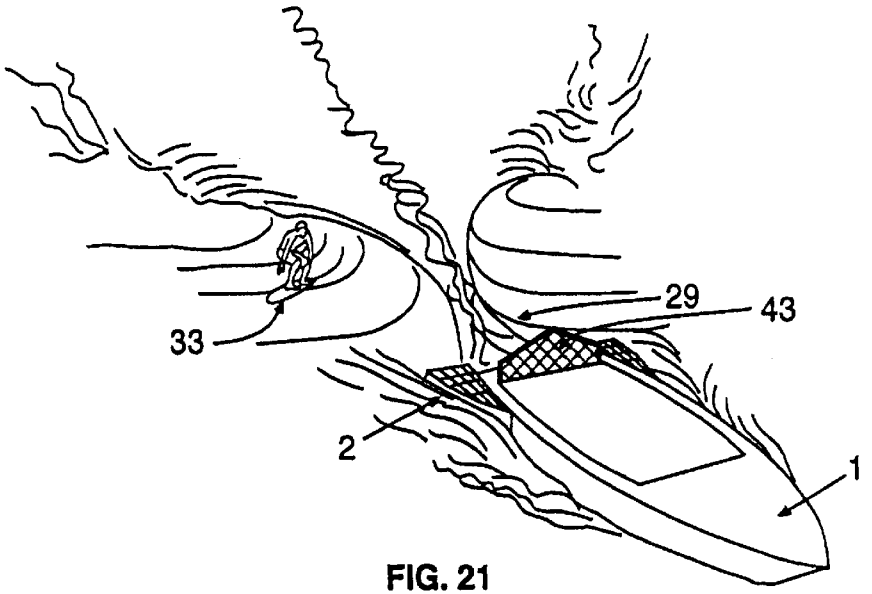
FIG. 21 shows a perspective view of the boat with the wake surfing embodiment attached in operation creating large waves and wake patterns behind the boat.

The above differences enable the larger embodiment 132 to displace more water, and therefore, create larger waves. Moreover, using this embodiment as a water ballast, more water can be placed in the device, helping to further increase the weight of the boat, and therefore, create larger waves. In such case, an anti-back-wash guard or mesh 43, as shown in FIG. 21, can be provided on the back end of the boat to protect against the unintended effects of the larger swells that are created. For example, in the event the boat comes to a sudden stop, the anti-backwash guard 43 serves to deflect the following stem wave that continues forward and which otherwise could swamp the boat if left unguarded. Additionally, a protective skirt, such as one made of a soft material, like foam, rubber, etc., can be provided on the transom or the anti-backwash guard 43 of the boat to protect riders from becoming injured in the event they accidentally fall forward as the boat slows down or comes to a stop.

Construction of the Present Invention:

The aforesaid embodiments of the present invention comprise only representative examples of a spectrum of intermediary side-mounted—or integrally-molded—devices for producing enhanced wakes at designated speeds, suitable for either wakeboarding or wake surfing. The protuberances and fairings are preferably conceived of as being hollow shells constructed of light-weight materials similar to those employed in fiberglass boat construction, and being interiorly-compartmented by structural bulkheads, and preferably equipped with means (e.g., a pump) for filling said compartments with water ballast, which can substantially increase the boat's displacement, and hence, its wave-making potential.

The present invention can be manufactured from a number of materials, including strong, light, semi-rigid, and durable materials, such as fiber-glass, steel, plastic, carbon graphite, wood, etc. Indeed, virtually any material from which boat hulls and boat hull parts are typically made can be used. Using these materials, the present invention can be manufactured using any one of a variety of methods, including injection molding. Moreover, the device is preferably made relatively seamless and smooth so that hydrodynamic drag and friction is reduced. The outer surface of the device is also preferably water-proof. If materials such as wood are used, which are porous, an outer sealant can be provided to seal the material.

The present invention can also be made from a flexible fabric, such as water-proof rubberized material. Using fabric has the advantage of being easily adapted to a wide range of boat hull shapes and of being lighter and more easily manufactured, handled and shipped. And, each device does not necessarily have to be custom manufactured for a particular boat. A single modular device, for example, can be made suitable for different types and sizes of boats, thereby reducing the need to custom make each device. The fabric is preferably provided with reinforcing to maintain its shape. For example, in addition to the rubber-like material itself, a net or mesh made of strong nylon cords or other materials can be provided. The fabric device is also preferably filled with water under pressure, as will be discussed, to maintain its shape.

In either the rigid or flexible fabric embodiments, the present invention is preferably hollow to make it physically lighter and provide good water ballast. The hollow interior is preferably capable of being filled with water during operation, such as through an inlet opening 22 on the front end 7, shown in FIG. 4*c*. The ballast preferably also has an outlet opening 23 on the back end 17, shown in FIGS. 4*b* and 4*d*, through which water can be drained, i.e., such as during acceleration. One or more plugs (not shown) can be provided on the openings to keep water in or out as the case may be.

Figure 15B:
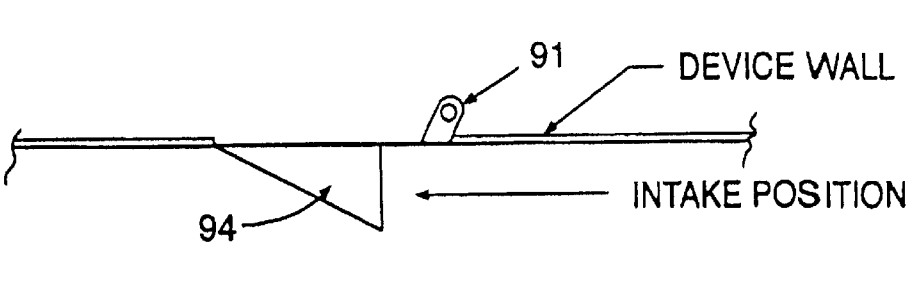
FIGS. 15*a*, 15*b* and 15*c* show a valve system for use with the present invention.
Figure 15A:
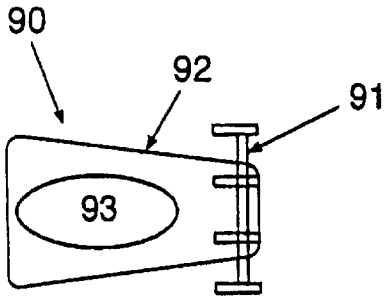
Figure 15C:
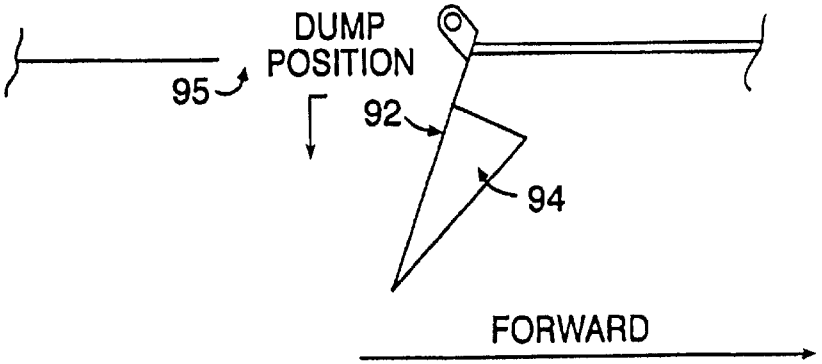

Openings with inlet/outlet valves, such as those shown in FIGS. 15*a*, 15*b* and 15*c*, can also be provided through which water can be introduced and discharged. To add water to the device, for example, the device can be adapted with an inlet/outlet valve 90. The valve 90 is preferably provided on the bottom of the device, as shown in FIGS. 15*b* and 15*c*, or somewhere below the water line. The valve 90 preferably has a valve door 92 that can be positioned over an opening 95. The door 92 pivots about a hinge 91 from an upper (closed) intake position, shown in FIG. 15*b*, to a lower (open) dump position, shown in FIG. 15*c*, and vice verse. The door 92 also has an inlet nozzle 93 thereon, as well as an outwardly extended, forward-facing, scoop 94.

As the boat moves forward, pressure from water applied against the scoop 94 causes the door 92 to swing up and stay in the intake position. Preferably, even a small amount of head pressure resulting from reduced speeds is sufficient to keep the door 92 closed. And, as pressure causes the door 92 to close, the scoop 94 causes water to flow up and enter into the device through inlet nozzle 93. As the boat moves forward, i.e., to wakeboarding and/or wake surfing speeds, the water pressure becomes sufficient enough to fill the entire device, and to keep the device filled. When the boat slows down and stops, however, the water pressure applied against the scoop 94 is eliminated, thereby causing the door 92 to drop to the open position. The pressure from the weight of the water in the device is generally sufficient to open the door 92, and dump the water in the device through opening 95 in a relatively short time.

Using the above inlet/outlet openings, the present invention allows the amount of water to be introduced into the device and therefore the weight of the boat to be adjusted. Also, by using internal baffling, and multiple openings and plugs, the interior space can be provided with arranged internal compartments which, in turn, can, by varying the amount of water in each compartment, allow the weight of the device along portions of its length to be varied and controlled. Such control enables fine-tuning of the boat's displacement characteristics and resultant wake formation.

Other means for introducing and releasing water into and from the device will be discussed later.

The protuberances are conceived of as being secured to the boat by quickly-removable fasteners. Many types of fasteners, including conventional clamps, male and female inserts, locks, bolts, etc., or other mechanism, can be used to removably secure the device to the boat. Easy to use locking and/or securing mechanisms are preferably used to enable fast and easy attachment and release. The device is preferably secured properly so that it can withstand the shear and moment forces that act on the device. The sidewalls 4 of the existing boat may require strengthening, which can be accomplished in any conventional manner.

Alternatively, the device 2 can be secured by hinges 24, as shown in FIG. 4*a*, such that the protuberances can be unlatched, drained of ballast, and swung up out of the water while being transported to and from an area of intended use. For this purpose, the upper surface 16 of the device 2 is preferably shaped to match or mate with the shape of the upper side walls 4. Any conventional locking devices to secure the device 2 in its lower and upper position can be used. Preferably, a locking device that can be operated without having to reach into the water is provided. A rubber-like seal can be provided along the edges of the mounting surface 12 of the device, or on the boat hull, or fixture 41, so that when the device is swung down into position, the device is sealed to the boat hull.

The Inverted Hydrofoil System:

The present invention can also be provided with an inverted hydrofoil system which helps to apply a downward pressure to the boat to further increase water displacement and therefore increase wave size. The system comprises one or more inverted hydrofoil members extending downward into the water from either the sides or bottom of the boat or protuberances near the maximum chine width or stern, wherein the immersion depth and attack angle of the members can be adjusted. The function of the adjustments is to increase the size of the waves within the wake pattern by dynamically controlling the boat's attitude and displacement.

In the embodiment shown in FIGS. 16*a* through 16*d*, a dual inverted hydrofoil system is provided, wherein each of the inverted hydrofoil members 151 is comprised of a horizontally disposed, inverted hydrofoil 153 maintained in position beneath the water surface by, for example, a vertical mounting strut 154 that is rigidly mounted by suitable, but removable, means to the sides of an existing boat hull. Means are provided for independently raising or lowering each hydrofoil 153 with respect to the boat hull, and also for adjusting its attitude, or pitch angle, with respect to the boat's waterline. The primary function of the hydrofoil is to produce a controllable downward force that opposes the upward force of water streaming beneath the hull of a planing boat, thus forcing the boat to operate in a more fully-displacement mode than the fully-planing mode for which it was designed. And, because both of the aforementioned forces are proportional to the square of the boat's speed, the same displacement conditions prevail at all operating speeds. The result is that when the boat is operated in the displacement mode it produces larger waves than when operated in the planing mode.

Another advantage of the inverted hydrofoil system of the present invention is that it eliminates the need for internal ballast to produce waves of increased size for surfing and wake boarding. Internal ballast, e.g., water bags, disadvantageously occupies inboard passenger/cargo space. Also, by use of the inverted hydrofoil system, the boat is directionally stabilized in roll, pitch, and yaw, as opposed to the destabilizing force of an internal ballast carried above the boat's center of gravity. Moreover, the hydrofoil members can be operated individually if desired, to steer the boat, or to travel in a wide arc with one stern quarter depressed, thus producing unusually large waves on the lower side.

Figure 16A:
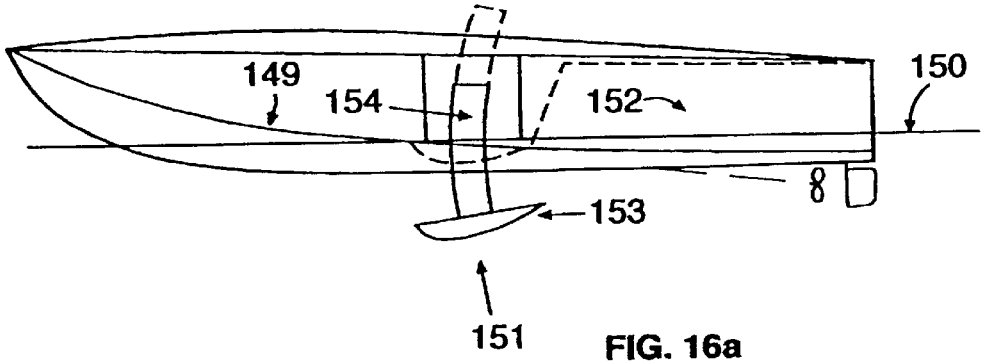
FIG. 16*a* is an elevation view of the boat showing an inverted hydrofoil system of the present invention with a hydrofoil member and adjustable strut attached to the side of the boat.

Referring now to FIG. 16*a*, shown is a side view of a conventional water-ski boat 149 similar to that shown in FIG. 1, at rest in still water 150, and showing one embodiment of the hydrofoil member 151 of the present invention mounted exteriorly on the left side of the boat. A mirror image of the member 151 (not shown) is similarly mounted on the opposite side of the boat 149. The hydrofoil member 151 is shown mounted somewhat forward of an optional wave pattern protuberance 152, indicated by dashed lines, although it can be deployed either with or without the protuberance 152. The hydrofoil members 151 can also be extended directly from the protuberances 152, on the front or lower portions thereof, if desired, as will be discussed.

Figure 16B:
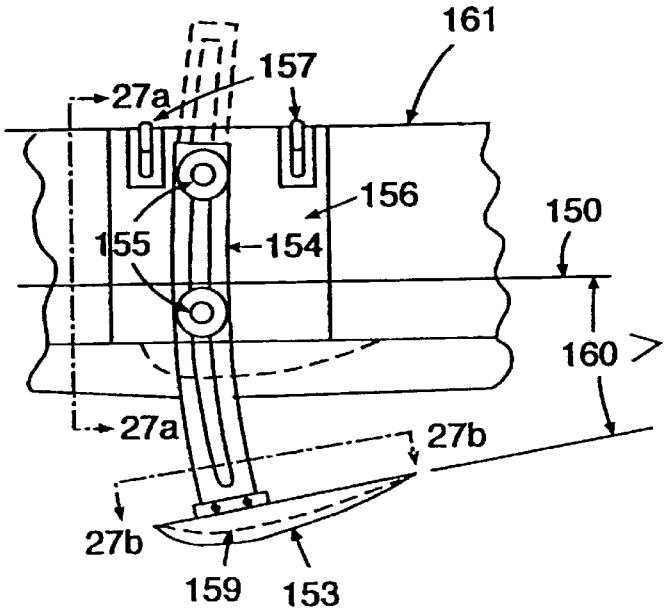
FIG. 16*b* is an elevation view of the inverted hydrofoil member and adjustment strut of the present invention shown in FIG. 16*a;*
Figure 16C:
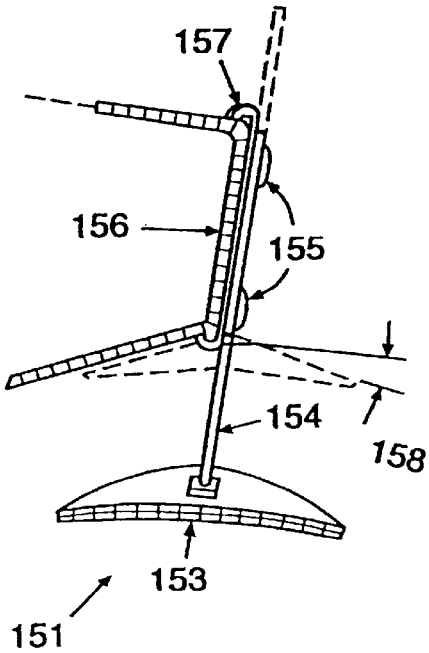
FIG. 16*c* is a front view of the inverted hydrofoil member and adjustment strut of the present invention shown in FIG. 16*a*.

FIG. 16*b* is an enlarged view of the hydrofoil member of FIG. 16*a* mounted on the side of a cutaway boat section 161. FIG. 16*c* is a sectional front view of the hydrofoil member 151, taken along the broken line 27*a*–27*a* of FIG. 16*b*. The inverted hydrofoil 153 is preferably rigidly secured by break-away or quick-removal pins or the like to the lower end of a curved strut 154. The strut can be slotted to receive two mounting bolts 155 that secure it to a mounting plate 156 that is secured, in turn, to the side of the boat by suitable fasteners 157.

Figure 16D:
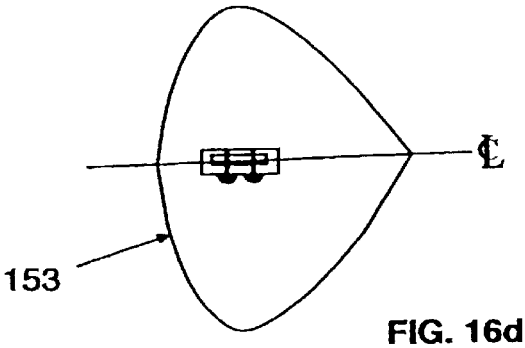
FIG. 16*d* is a top view of the inverted hydrofoil member of the present invention shown in FIG. 16*a*.

FIG. 16*d* is a top view of the hydrofoil 153, taken along the broken line 27*b*–27*b* of FIG. 16*b*. The hydrofoil 153 has the shape of a thick, inverted kite, whose stubby wings make a negative dihedral half-angle 158, as shown in FIG. 16*c*, with the mounting strut 154. The angle is preferably about 10 degrees, although it can be higher or lower. All fore and aft wing section profiles are inverted airfoils, similar to the dashed centerline profile 159, shown in FIG. 16*b*. In the preferred embodiment, the area of each hydrofoil 153 preferably approximates about ten per cent of the boat's waterline area between the chines, although this amount can be higher or lower.

Operationally, by loosening the mounting bolts 155, the strut can be raised or lowered with respect to the boat hull, and secured in any position permitted by the slot length by tightening the bolts. Because of its curvature, raising and lowering the strut permits adjustment of the immersion depth and angle of attack 160 of the hydrofoil 153 with respect to the boat's still waterline 150, as shown in FIG. 16*b*, so as to achieve certain performance objectives.

When fully raised, as indicated by dashed lines, the hydrofoil 153 is nested against the underside of the boat hull, with zero angle of attack with respect to water flow past the hull. In this manner, the boat can operate at high water skiing speeds, i.e., over 30 mph, in a fully planing attitude. At reduced wakeboarding speeds, i.e., about 20 mph, the hydrofoil 153 can be partially lowered, with a negative attack angle of about four to six degrees, although this amount can be higher or lower. In this manner, the boat can be operated in a semi-planing mode, wherein the hydrofoil produces a downward force that acts on the boat sufficient to increase displacement and produce larger wakeboarding waves. At even more reduced wake surfing speeds, i.e., about 10 mph, the hydrofoil 153 can be fully lowered, with a negative attack angle of about seven to ten degrees. In this manner, the boat can operate at full power, wherein the hydrofoil produces an even greater downward force sufficient to further increase displacement such that even larger surfing waves are produced. In each of the above circumstances, the hydrofoil member 151 acts to increase the boat's operational displacement, which results in increasing the size of the waves in the boat's wake pattern, but without appreciably altering the various wave patterns attributable to the previously described embodiments described in relation to FIGS. 1–15.

Figure 17A:
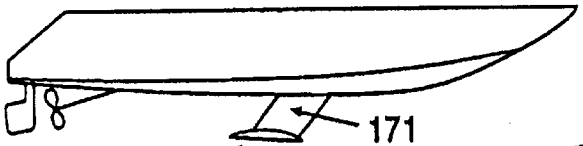
FIGS. 17*a*, 17*b* and 17*c* show various views of another embodiment of the inverted hydrofoil system of the present invention having a single inverted hydrofoil member.
Figure 17B:
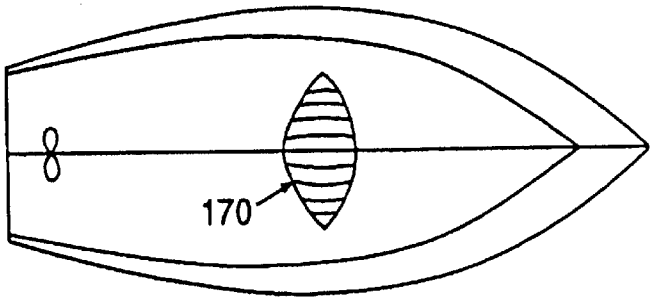
Figure 17C:
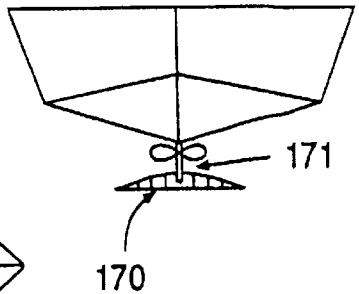

In the embodiment shown in FIGS. 17*a*, 17*b* and 17*c*, an inverted hydrofoil system using a single inverted hydrofoil 170 is provided. The hydrofoil 170 is mounted on a strut 171 extending downward from the bottom of the boat hull substantially in the center thereof. The strut 171, as shown in FIGS. 17*a* and 17*c*, is preferably thin in relation to the fore and aft direction, i.e., the direction of travel, and relatively wide in side view as shown in FIG. 17*a*. A pivoting means (not shown) is preferably provided at the connection point between the hydrofoil 170 and strut 171 to allow the hydrofoil attack angle to be adjusted and secured. The pivoting means can be any conventional type, such as a hinge with a lock using nut and bolt fasteners, etc. Alternatively, strut 171 could be raised or lowered with respect to the boat hull in a manner similar to that shown in FIG. 16*b*. In this case, strut 171 would be encased in a centerboard/daggerboard mounting enclosure (not shown) as commonly used on sail boats, and secured in any position permitted by the centerboard slide length and securing mechanism, e.g., bolt or clamp. Likewise, through the use of a curved strut 154 as shown in FIG. 16*b*, raising and lowering the strut permits adjustment of the immersion depth and attack angle 160 of the hydrofoil 153 (with respect to the boat's still waterline 150) so as to achieve the desired performance objectives, i.e., to lift water upward and create a reciprocal downward force on the boat.

Figure 18A:
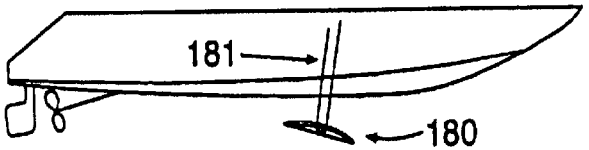
FIGS. 18*a*, 18*b* and 18*c* show various views of another embodiment of the inverted hydrofoil system of the present invention having a two point inverted hydrofoil system.
Figure 18B:
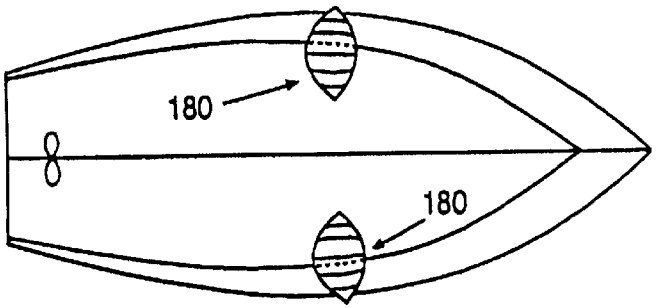
Figure 18C:
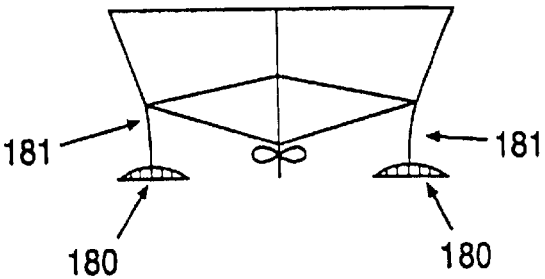

In the embodiment shown in FIGS. 18*a*, 18*b* and 18*c*, another inverted hydrofoil system using two inverted hydrofoil members 180 is provided. The hydrofoil members 180 are mounted on struts 181 extending downward substantially vertically from the sides of the boat hull. Unlike the embodiment of FIGS. 16*a*–16*d*, a pivoting means (not shown) is preferably provided at the connection point between the hydrofoil member 180 and strut 181 to allow the hydrofoil attack angle to be adjusted. Again, the pivoting means can be any conventional type. Like the other hydrofoil members discussed above, the two hydrofoil members serve to lift water upward and create a reciprocal downward force on the boat.

Figure 19A:
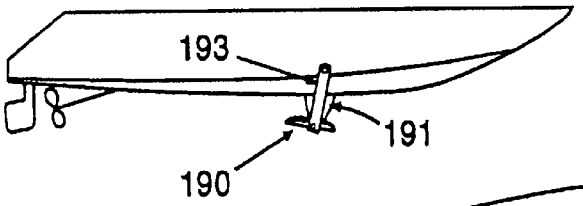
FIGS. 19*a*, 19*b* and 19*c* show various views of another embodiment of the inverted hydrofoil system of the present invention having a three point inverted hydrofoil system.
Figure 19B:
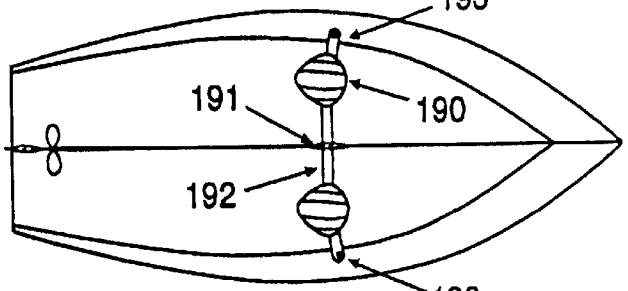
Figure 19C:
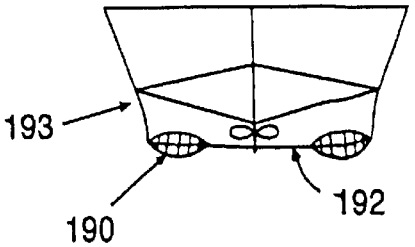

In the embodiment shown in FIGS. 19*a*, 19*b* and 19*c*, another inverted hydrofoil system using a three point connection with two inverted hydrofoil members 190 and a cross member 192 is provided. The two hydrofoil members 190 are preferably pivotally mounted (on the outside) on struts 193 extending downward from the sides of the boat hull, and (on the inside) by the center cross member 192, which is connected to and extends between the two hydrofoil members 190. The cross member 192, which is preferably flat, is also connected to and pivots about a center strut 191 extending downward from the bottom of the boat. The hydrofoil members 190 and cross member 192 are connected together in a manner that allows them to pivot together about the three connection points, i.e., the two struts 193 and center strut 192, such that the attack angle of the three members can be adjusted. Together, like the other hydrofoil members discussed above, the three members serve to lift water upward and create a reciprocal downward force on the boat.

Figure 20A:
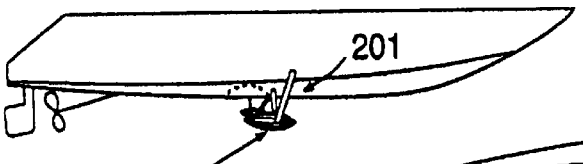
FIGS. 20*a*, 20*b* and 20*c* show various views of another embodiment of the inverted hydrofoil system of the present invention having a four point inverted hydrofoil system.
Figure 20B:
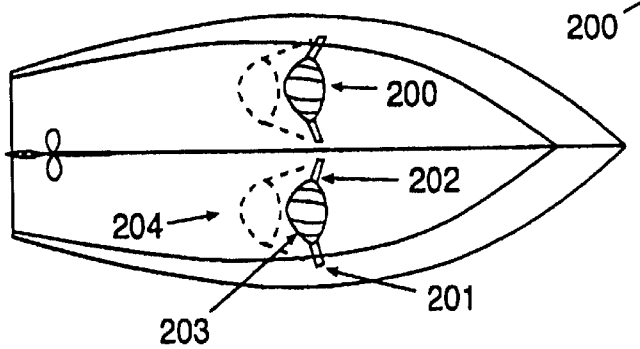
Figure 20C:
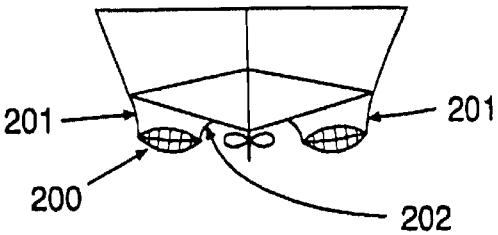

In the embodiment shown in FIGS. 20*a*, 20*b* and 20*c*, another inverted hydrofoil system using a four-point connection with two inverted hydrofoils is provided. In this embodiment, two inverted hydrofoil members 200 are each connected to the boat by two pivoting struts, 201 and 202. Struts 201 extend downward from the sides of the boat hull and connect to the hydrofoil member 200 on the outside thereof. Struts 202 extend downward from the bottom of the boat hull near the center thereof and connect to the inside of the hydrofoil member 200. The struts 201, 202 are adapted to pivot at the top in relation to the boat hull and at the bottom in relation to the hydrofoil members 200, such that the hydrofoil members 200 can be swung from a lower operating position 203, to an upper non-operating position 204, which is nested against the underside of the boat hull. Moreover, in this manner, the attack angle of the hydrofoil members 200 can also be adjusted.

In each of these embodiments, the inverted hydrofoil members and struts are similar in construction to those discussed in relation to FIGS. 16*a*–16*d* (except the struts are not necessarily curved). The pivoting connections are intended to allow the hydrofoil members to be adjusted to and secured at the proper attack angle when desired. Accordingly, sufficiently strong adjustments and fastening mechanisms such as those discussed above and others that are known in the art are preferably provided. Additional bracing of the boat hull where the struts are connected to the boat are also preferably provided if necessary. Furthermore, all hydrofoil embodiments can be remotely actuated, if desired, by hydraulic or other powered means to enable rapid deployment.

Figures 23, 23A, 23B:
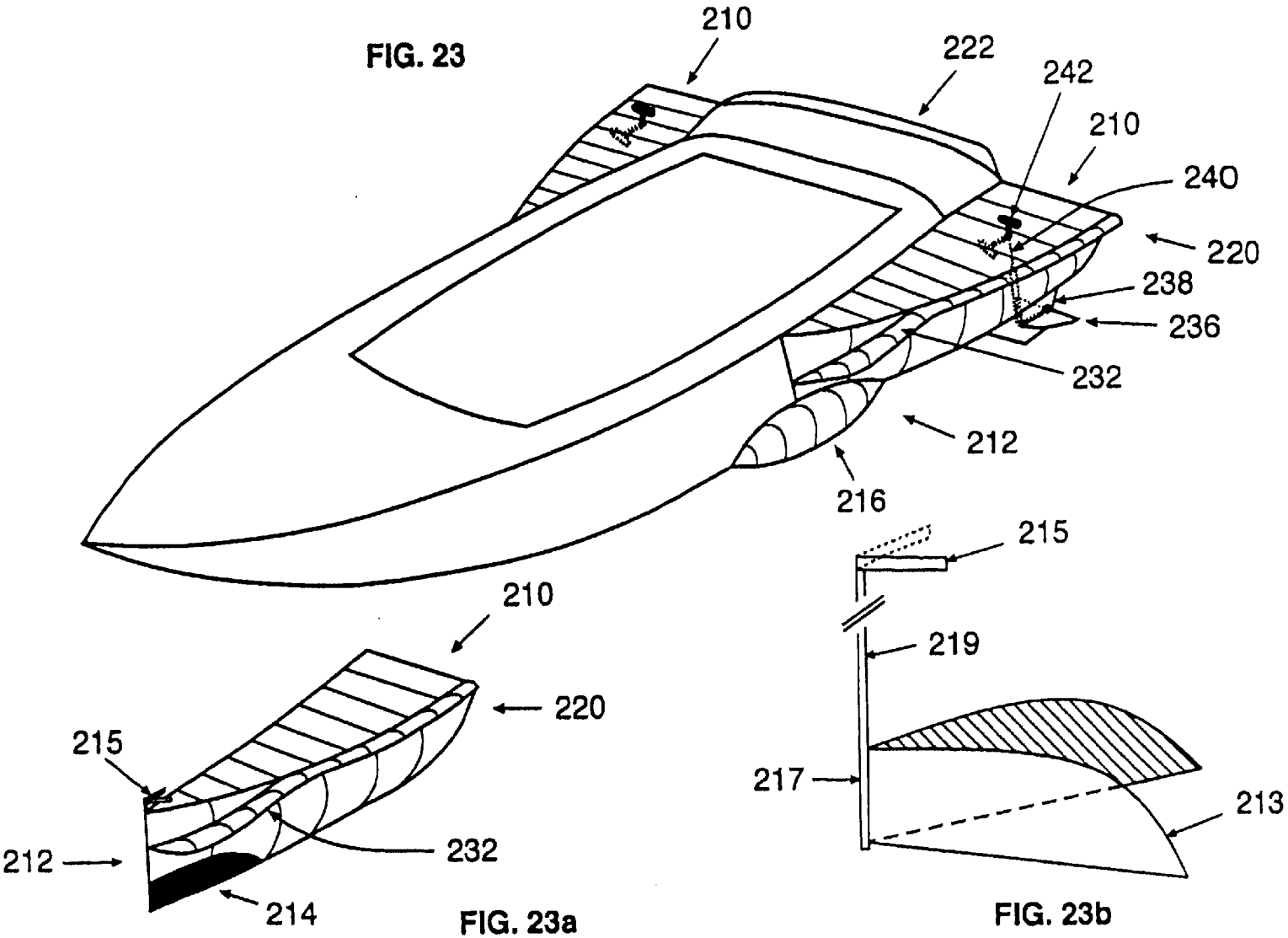
FIG. 23 shows a perspective view of an embodiment of the present invention which incorporates multiple aspects of the present invention.
FIG. 23*a* shows a perspective view of the protuberance of the present invention shown in FIG. 23 which incorporates multiple aspects of the present invention.
FIG. 23*b* shows an alternative inlet gate on the protuberance of the present invention shown in FIG. 23*a;*
Figure 24:
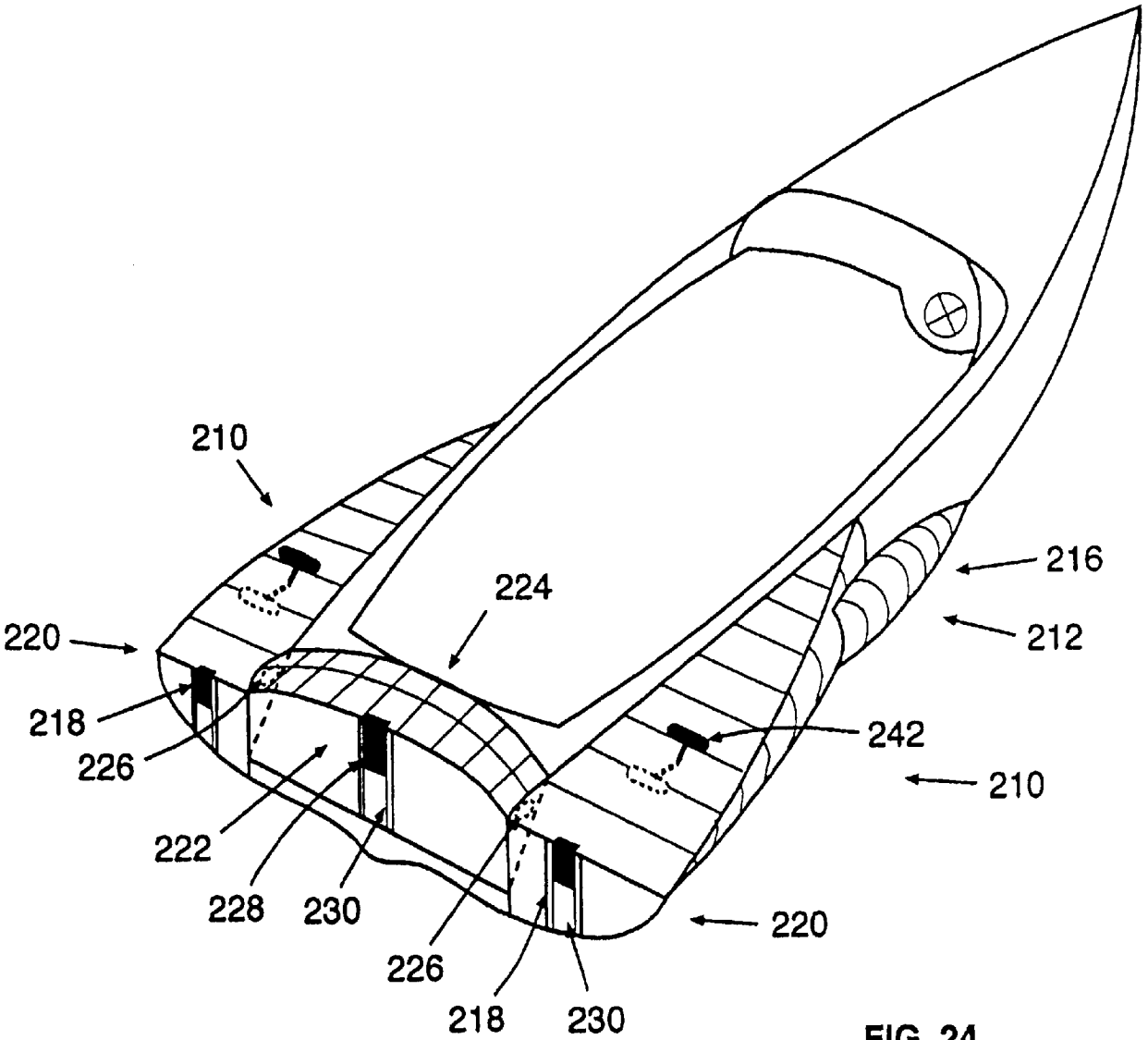
FIG. 24 shows a rear perspective view of the embodiment of the present invention shown in FIG. 23 which incorporates multiple aspects of the present invention.
Figure 25:
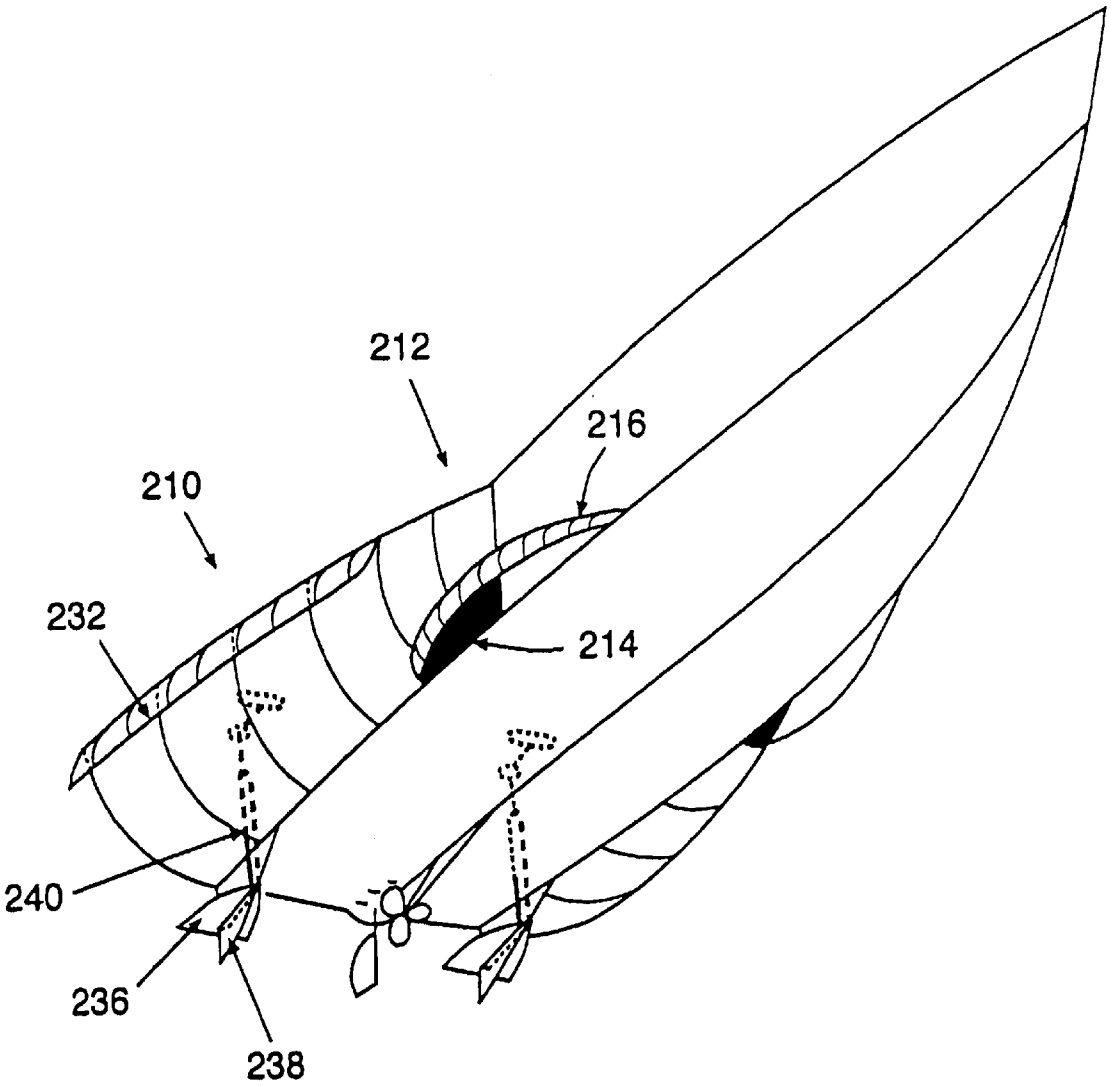
FIG. 25 shows a lower perspective view of the embodiment of the present invention shown in FIG. 23 which incorporates multiple aspects of the present invention.

The Combination Embodiment:

The embodiment shown in FIGS. 23–25 comprises two hollow protuberant fairings 210 which are similar to those described previously, attached to or otherwise extended from the boat hull. As shown in FIGS. 23 and 23*a*, the forward end 212 in this embodiment is provided with an opening 214 and optionally an associated cowling 216 as shown. The opening 214 is an inlet, which allows water to enter into the protuberances for ballasting and displacement augmentation purposes. The cowling 216 is an inverted shell-like member that has a downwardly facing concave surface, which helps to capture bow spray and feed water into the opening 214. Water pressure applied by the movement of the boat forward causes water to enter the opening 214 to fill the ballast, and therefore, add weight to the boat and increase wave size. The weight of the water in the ballast near the stem causes the pitch attitude of the boat to increase and offset the increased planing surface created by the protuberances.

The inlet opening 214 can be provided with an optional inlet gate 213, as shown in FIG. 23*b*, which can be used to prevent water from entering the protuberance. The gate is capable of being in the open and closed positions and can be operated by a lever 215 as shown. With the gate in the closed position, the boat can be accelerated and operated without excess drag associated with water filling the protuberance. Once the boat reaches ideal speeds, however, the gate can be opened to allow water to enter the protuberance, enabling the boat to operate in the manner discussed herein. The inlet gate 213 and time delay method of loading ballast minimizes the engine power required to operate a ballasted boat. Furthermore, it enables the boat to add displacement (and hence increase wake size in a planing mode) in excess of the maximum normally achievable had ballast been in place from a dead start. Inlet gate 213 can be constructed from the same materials as the protuberances and either made to hinge or slide to open or shut. If hinged, either the front or back of the inlet gate 213 can be pivoted 217 and the gate made to adjust by pivoting about that point, such that the opening 214 can be adjusted as desired. Additional braces and connectors can also be provided to secure the gate in position, which can be either manually or electronically operated, either from the boat or in the water, in any conventional manner. For example, from the boat, a control arm 219 can be extended up from inlet gate 213 through the protuberance and extended as a lever 215 onto the boat deck. The control arm 219 is preferably connected to the inlet gate 213 and made accessible from the passenger compartment so that the opening 214 can be adjusted without having to reach down into the water.

In addition to the inlet openings 214, the protuberances are provided with outlet openings 218 at the back end 220, as shown in FIG. 24. The outlet openings 218 are preferably adjustable to a size greater than the inlet openings 214 in order to minimize restriction and maximize an internal flow-through of water from the front end 212 to the back end 220 during operation. This enables water to enter into the ballast and exit at approximately the same rate while the boat moves forward. To enable more water to fill the ballast rather than simply pass through, however, the outlet opening 218 is preferably positioned at a higher elevation on the back end 220 than the inlet opening 214 on the front end 212. That is, as water enters the ballast from pressure applied at the front end 212, water will be forced into the ballast until it reaches the level of the higher outlet opening 218, in which case water will begin to flow out through the ballast and outlet opening 218. The elevation differential of the two openings 214 and 218 will cause water to stay in the ballast to provide greater displacement so long as there is forward momentum applied by the boat. As soon as the boat stops, however, water will automatically drain from the ballast backward through the front inlet opening 214.

The elevation differential also creates a pressure differential. Because water has to travel upward from the front end 212 to the back end 220 to pass through the ballast, a pressure differential between the two openings is created. As water seeks the path of least resistance, it will, with enough pressure from the boat moving forward, travel up through the ballast from the inlet opening 214 and through the outlet opening 218. More importantly, the energy required to elevate water from the lower inlet opening 214 to the higher outlet opening 218 causes a reciprocal downward force which is similar to the downward force caused by the forward inclined surface 21 discussed earlier. That is, as water is forced upward from the inlet opening 214 to the outlet opening 218, the lifting effect created thereby creates a reciprocal downward force which helps to drive the boat further into the water.

An ancillary feature of this embodiment is a center ballast 222 which is preferably positioned over the transom 224 between the two protuberances. The center ballast 222 is preferably connected to the protuberances such that water in the protuberances can pass directly into the center ballast through additional transition openings 226 on or near the back end 220. The additional transition openings 226, like the outlet openings 218, are preferably positioned at a higher elevation than the inlet openings 214, so that the protuberances, i.e., side ballasts, will fill with water before the center ballast 222. Once the protuberances are filled with water and water reaches the level of the transition openings 226, with enough pressure, water will begin to fill the center ballast 222.

The center ballast 222 is also provided with an additional outlet opening 228 which preferably has a sliding gate 230 (mechanical or electrically operated) to enable the size and elevation of the additional opening 228 to be adjusted. In this manner, the level at which the water will begin to drain out through the additional outlet opening 228, and therefore, the level to which the center ballast can be filled with water before draining, can be adjusted. Even without a sliding gate 230, the center ballast 222 can be made higher in elevation than the transition openings 226, such that the center ballast fills with water when pressure from the boat moving forward is great enough, but automatically drains water through the transition openings 226 and inlet openings 214 when the boat comes to a stop. In any case, the center ballast and side ballasts each have at least one opening, i.e., such as a plugged or valved opening, which is located at the lowermost floor thereof to enable water to drain properly at shut-down. The center ballast 222 can also be shaped to prevent water from filling the boat when it comes to a stop, much like the anti-back wash guard 43 discussed above. Additional fillable ballast tanks (not shown) can be added as desired to other areas of the boat, e.g., the bow, in order to properly trim the boat for maximum wave size and desired wave shape. Such additional ballast tanks could have a filling conduit connected to the protuberances and drain line outlets as described above.

The above placement of the openings and construction of the ballasts enables the present invention to provide good ballasting during operation and automatically drain ballast when the boat comes to a stop or is not in use. The openings are also adapted so that no pumps or valves are needed. Rather, water pressure or lack thereof from the boat moving forward or stopping is used advantageously to cause water to enter into and/or exit from the ballasts.

The sides of the protuberances can also be provided with a splashguard 232 as shown in FIG. 23. The splashguard 232 essentially extends outward from the rounded section 15 of the protuberance to prevent or limit the amount of splash water that can form along the sides of the boat. It preferably extends longitudinally along the length of the protuberances above the projected water line during the greatest displacement caused by the boat. The cowling 216 also serves as a form of splash guard in that it captures some of the bow spray.

In this embodiment, an inverted hydrofoil system can also be provided, as shown in FIGS. 23 and 25, which not only helps to cause the boat to travel deeper, but also stabilizes the boat, particularly on hard turns. This system generally comprises two inverted hydrofoil members 236, like those previously discussed, which are each connected to a vertical stabilizing strut 238 extending from the bottom stem portion of the protuberances or boat hull. The hydrofoil members 236 can be constructed in much the same manner as the other inverted hydrofoil members discussed above. For example, the hydrofoil members 236 preferably pivot about one or more points so that the attack angle can be adjusted. Either the front or back of the hydrofoil member can be pivoted and the member adjusted by pivoting about that point, wherein the hydrofoil angle can be tiled up or down. Additional braces and connectors, like those discussed in relation to FIGS. 16*a*–16*d*, can also be provided to secure the hydrofoil members 236 in position. The hydrofoil members can be either manually or electronically operated, either from the boat or in the water, in any conventional manner. From the boat, for example, a control arm 240 can be extended up from the hydrofoil member 236 through the protuberance and extended as a lever 242 onto the boat deck. The control arm 240 is preferably connected to the hydrofoil member 236 and made accessible from the passenger compartment so that the attack angle can be adjusted without having to reach into the water. The angle of the inverted hydrofoil members 236 helps to drive the boat deeper in the water to create larger waves, and the extended strut 238 which is relatively wide helps to stabilize the boat much like a secondary rudder.

Figure 22:
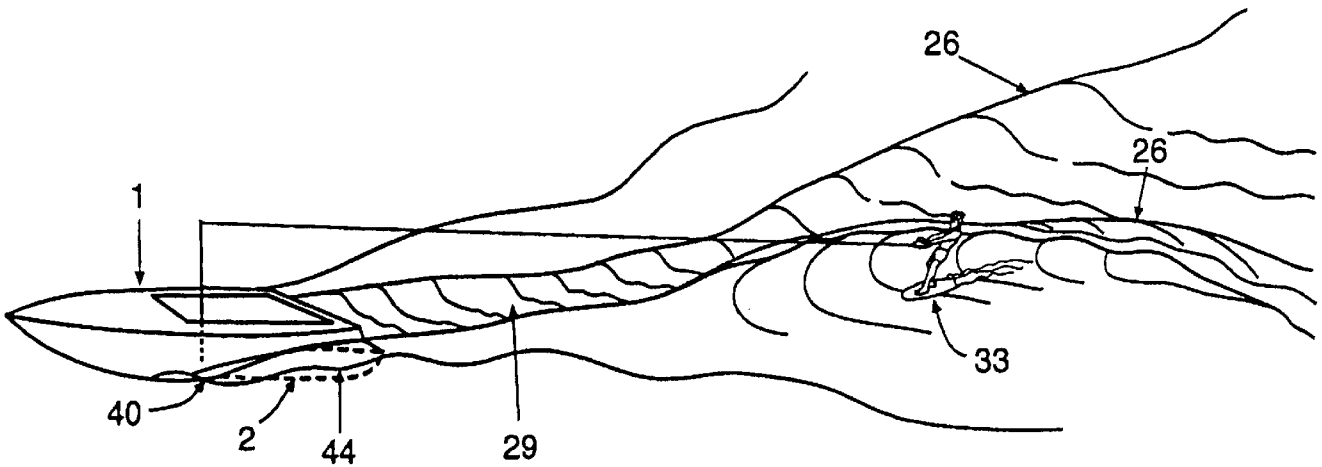
FIG. 22 shows a perspective view of the boat and wake enhancement device of the present invention in operation creating enhanced wake patterns.

Operation for Wake Boarding:

Once the device 2 is mounted onto the boat, the boat can be operated in the usual way, as shown in FIG. 22, for wakeboarding purposes. Unlike the sport of water skiing, where the speed of the boat must be close to 30 mph or more, the sport of wakeboarding can be performed at speeds ranging from about 18 to 24 mph. At those speeds, the present invention helps to create more desirable and larger waves suitable for performing wake board maneuvers.

As the boat moves through the water, as generally shown in FIG. 22, the boat's hull displaces water, generally pushing the water forward, laterally outward and down. The front of the boat's bow cuts through the water initially, and then the remainder of the bow follows immediately behind it to cause the water to build up along the sides of the boat, i.e., to form a primary bow wave 40. As the boat continues to pass, the water displaced initially by the boat's bow is then met by the wake enhancement device 2 of the present invention. At that point, the wake enhancement device creates additional interference and causes additional water to be displaced. The water that builds up along the sides of the boat due to the wake enhancement device is generally higher than the level achieved by the boat's bow alone. This summative process is termed "constructive interference."

The larger constructive bow wave 44, along with an increase in the amount of water displaced by the combination of the boat hull and wake enhancement device, helps to create an even bigger hollow or cavity 29 behind the boat. The greater pressure differential that exists between the area displaced by the hull and water that builds up along the sides helps to form larger diverging waves. That is, as more water builds up on the sides, and more water is needed to fill the hollow to return the water to an equilibrium point, more energy is exerted which creates larger waves. Furthermore, the unique shape and position of the protuberances on the boat serves to coordinate the merger of several wave envelopes (i.e., bow, evanescent and transverse waves) into a harmonious "crescendo" of motion, thereby creating an ideally shaped diverging stern wave 26.

The shape of the resultant diverging wave 26 that is created by the device preferably provides a better ramp for launching wake board maneuvers. The improved wave is not only is bigger, but also the wave shape preferably has a solid ripple free foundation with bigger radial transition from trough to crest, rises to a firm vertical lip with near right angle transition to a flat table that preferably extends along the crest. It also has fewer kinks in the surrounding water surface which could adversely affect the wakeboarder's 33 ability to traverse and jump the waves. The wave also preferably does not feel mushy which can occur when the lip crumbles prematurely, or the lip is too thin and peaky, or the wave has air bubbles entrained within. These attributes of the diverging wave are preferably attainable by the boat traveling at ideal wakeboarding speeds, i.e., about 20 mph. The driver can also alter the shape of the diverging waves by turning the boat from side to side if desired.

Operation for Wake Surfing:

For wake surfing, as shown in FIG. 21, the boat operates in substantially the same manner as the wake board embodiment, except that it preferably travels considerably slower, i.e., about 7 to 17 miles per hour, as discussed in relation to FIGS. 13*a–b* and 14*a–b*, with a preferred range of 9 to 13 mph, although these ranges can be higher or lower. The wake surfer 33, as shown in FIG. 21, also travels on a board, i.e., a surf board, without the aid of a rope. The speed of the boat will likely be slower due to the additional drag created by the device 2, but also, the speed is intended to simulate the speed at which an ocean wave travels through the water for simulating actual surfing conditions. The speed is also intended, to some extent, to match the speed at which the boat would, without the device, create the largest diverging wave possible, i.e., the hull speed, as discussed previously. In this respect, the device is designed to amplify the effects of the boat's hull in a manner that substantially maintains the frequencies and harmonics of the water effects naturally created by the boat's hull. That is, to the extent the boat's natural hull speed is substantially close to the speed at which the optimum diverging wave is created by the wake surfing embodiment, the device is designed so that the effects it creates are substantially in phase, or substantially stable and/or in constant relation, with the boat's natural wave effects. In this manner, the device can maximize the extent to which the boat and device work together to create coherent bow waves and diverging waves of the quality, shape and size needed for advanced surfing maneuvers. At the same time, the present invention helps to form the waves further astern.

While the present invention is disclosed in several embodiments, it should be understood that it is not limited to the specific embodiments disclosed herein. Nor is the present invention limited to the specific features and combination of features disclosed in the specification. Instead, the present invention contemplates various wake enhancement devices and systems of various sizes and shapes defined by their ability to help increase displacement and produce the types of interference and reflections, as discussed herein, that are needed to form wave and/or wake effects which are desirable for wakeboarding and wake surfing. The present invention also contemplates that it can be adapted to boats of various shapes and sizes and will enable them to perform in the intended manner. The concepts and principles disclosed herein are intended to be applicable to many kinds of planing hull boats, which enable the present invention to create the desired waves and/or wake patterns in different applications using different boats.

What is claimed is:

1. A wake enhancement device for use with a boat, comprising:

a laterally extended section, having a forward and rearward portion, wherein the section extends substantially longitudinally in relation to the boat's hull, at or near the water line, wherein the extended section increases the effective width of the boat, and, during operation, causes additional water to be displaced and build up along the side of the boat, wherein the forward portion of the extended section has an inclination thereon, and wherein said inclination extends substantially upward and rearward such that as the boat travels through the water, the forward portion travels below the water line and helps to lift water upward, which in turn creates a reciprocal downward force that acts on the device and boat.

2. The wake enhancement device of claim 1, wherein a tangent line defining the outer-most laterally extended surface of the section extends upward and rearward from the forward portion to the rearward portion.

3. The wake enhancement device of claim 2, wherein the tangent line has an inclined slope and is curved along a substantially convex line in plan view such that it extends further outward than the widest point of the boat hull.

4. The wake enhancement device of claim 1, wherein the extended section has an exteriorly rounded surface that extends longitudinally along the length of the section.

5. The wake enhancement device of claim 4, wherein the rounded surface on or near the rearward portion has a cross-sectional shape substantially defined by its radius, wherein the radius is a function of the draft of the water at the chine, as determined with the boat traveling at operating speeds without the device, multiplied by a preselected factor ranging between 1 and 20.

6. The wake enhancement device of claim 5, wherein the radius is a function of the draft multiplied by a factor of about 5.

7. The wake enhancement device of claim 1, wherein the forward portion extends outward in relation to the boat hull in plan view at an angle of between 10 to 20 degrees, or between 20 to 40 degrees.

8. The wake enhancement device of claim 1, wherein the device is integrally formed with the boat hull or mounted to the sides of the boat hull.

9. The wake enhancement device of claim 1, wherein the device has one or more hinges that are provided to connect the section to the boat such that the section can be swung upward in relation to the boat hull.

10. The wake enhancement device of claim 1, wherein the device is hollow and has at least one opening and/or valve through which water can be introduced.

11. The wake enhancement device of claim 10, wherein the valve comprises a door with a nozzle and scoop for scooping water into said section through said nozzle.

12. The wake enhancement device of claim 10, wherein an opening is positioned on or near the front portion of the device and another opening is positioned on or near the rearward portion.

13. The wake enhancement device of claim 1, wherein the section is tapered such that the section is relatively wide near the rearward portion and relatively narrow near the forward portion, and wherein the forward portion is faired into the side of the boat hull.

14. The wake enhancement device of claim 1, wherein the rearward portion terminates at about the back end of the boat, and has a terminating surface having a hard edge thereon.

15. The wake enhancement device of claim 1, wherein one or more inverted hydrofoil members are provided, wherein said hydrofoil members are inverted to lift water up and cause a reciprocal downward force to act on said boat during operation.

16. The wake enhancement device of claim 1, wherein each of said one or more inverted hydrofoil members is connected in a manner that allows the attack angle to be adjusted, and extends into the water from the sides or bottom of the boat hull.

17. The wake enhancement device of claim 1, wherein a second section protruding from said extended section is provided to further increase the effective width of the aft section of the boat.

18. The wake enhancement device of claim 1, wherein the extended section is made from a flexible fabric which can be filled with water to hold its shape.

19. The wake enhancement device of claim 1, wherein said extended section has a splash guard.

20. A wake enhancement device for use with a boat, comprising:

a laterally extended section, having a forward and rearward portion, wherein the section extends substantially longitudinally in relation to the boat's hull, at or near the water line, wherein the extended section increases the effective width of the boat, and wherein the extended section is hollow and has an opening on the front portion which is lower in elevation than an opening on the rearward portion, wherein the transition of internal flow-through water under pressure from the front opening to the rearward opening helps to lift water upward to create a reciprocal downward force on the boat.

21. The wake enhancement device of claim 20, wherein the opening on the rearward portion is greater in size than the opening on the front portion, and an adjustable gate is provided on said rearward opening.

22. The wake enhancement device of claim 20, wherein two extended sections are provided and a center ballast is provided between the two extended sections, and the center ballast is connected to the extended sections such that water from inside the extended sections can be introduced through said opening in said rearward Portion into said center ballast through a transition opening.

23. The wake enhancement device of claim 22, wherein the center ballast has an outlet opening that is capable of being adjusted by a gate.

24. The wake enhancement device of claim 20, wherein said opening on the front portion has a cowling extended therefrom to capture bow spray, and an inlet gate for restricting the introduction of water into said device.

25. A method for improving the quality and size of a wake created behind a boat, comprising:

extending two elongated sections substantially from the boat's hull, said elongated sections each being substantially hollow and having an exterior surface that extends substantially longitudinally along said section to increase the effective width of the boat;

providing an opening on the forward portion of each of said sections such that during operation water is able to enter into said sections through said openings; and causing the boat to travel through a body of water, wherein as the boat travels through the water, water is introduced under pressure into said sections through said openings to increase the effective weight of said boat, and create a downward force that acts on said boat, wherein the elongated sections cause additional water to be displaced and build up along the sides of the boat, to help create additional wake effects.

26. The method of claim 25, wherein the step of causing said boat to travel through said body of water causes said sections to constructively interfere with the primary bow waves created by said boat, thereby creating a larger constructive wave and increasing the size of the diverging stern waves created behind said boat.

27. The method of claim 25, wherein the step of causing said boat to travel through said body of water causes water that builds up along the sides of the boat to transition smoothly into the hollow created by the displacement of water behind the boat, helping to form substantially larger and/or smoother waves behind the boat.

28. The method of claim 25, wherein the step of causing said boat to travel through said body of water creates a larger and/or wider hollow in the water behind the boat, whereby water that builds up along the sides of the boat takes longer to converge, thereby helping to form waves further behind the boat than without said sections.

29. The method of claim 25, wherein the step of causing said boat to travel through said body of water causes the front portion of said elongated sections to travel below the water surface, causing water to be lifted upward, and creating a reciprocal downward force to act upon the sections, resulting in the boat traveling deeper in the water.

30. The method of claim 25, further comprising the step of providing one or more inverted hydrofoil members extending downward into the water in relation to the boat hull, wherein each of said one or more inverted hydrofoil members is inverted such that it lifts water upward to create a reciprocal downward force that acts on said boat, to cause said boat to travel deeper in the water than without said hydrofoil members.

31. The method of claim 25, wherein the method comprises providing a second opening on each of said sections on the rearward portions thereof, said second openings being positioned and oriented such that during operation, water can exit from said sections through said second openings; and positioning said forward opening on each section at a position that is lower in elevation than said second opening on each section, wherein water is able to fill said sections and the internal flow-through of water through the sections from the front openings to the rear openings creates a lift force which creates a reciprocal downward force on the boat.

32. The method of claim 31, wherein the method comprises the step of providing an inlet gate on said forward openings to restrict the introduction of water into the elongated sections, and an adjustable gate on the rearward openings to adjust the size and location thereof.

33. The method of claim 25, wherein the method comprises providing a center ballast which can be filled with water to increase the weight of the boat, said center ballast being connected in a manner that allows water from inside said extended sections to enter into said center ballast through one or more transition openings.

34. The method of claim 33, wherein the center ballast is provided with a sliding gate which can be used to adjust the size of an outlet opening and enables the amount of water that can fill the center ballast before water is drained to be adjusted.

35. The method of claim 25, wherein said method comprises the step of extending elongated sections from said boat hull that are made from a flexible fabric which can be filled with water to hold its shape.

36. A method for improving the quality and size of a wake created behind a boat, comprising:

providing one or more openings on said boat's hull, said one or more openings extending below the water line of said boat and being adapted such that during operation water is able to enter through said one or more openings into one or more cavities extending within said hull;

causing said boat to travel through a body of water, wherein as the boat travels through said body of water, water is introduced under pressure into said one or more cavities through said one or more openings, wherein said water in said one or more cavities increases the effective weight of said boat, and creates a downward force that acts on said boat while said boat is traveling through said body of water; and causing said boat to slow down and/or stop such that said pressure is reduced and water in said one or more cavities is allowed to drain out through said one or more openings by gravity alone.

37. The method of claim 36, comprising the additional step of adapting said one or more openings with a forward orientation such that when said boat travels through said body of water, water is introduced into said one or more cavities through said one or more openings.

38. The method of claim 36, comprising the additional step of extending said one or more cavities above said water line such that when said boat is at rest, water within said one or more cavities is allowed to drain back out through said one or more openings by gravity alone.

39. The method of claim 36, comprising the additional step of providing one or more gates to control the entry or exit of water through said one or more openings into said one or more cavities.

40. The method of claim 36, comprising the additional step of providing a cowling to help direct water into said one or more openings.

41. The method of claim 36, comprising the additional step of providing at least two openings on said boat hull, one opening located near the front of said one or more cavities, and a second opening located near the rear of said one or more cavities, wherein said front opening is lower in elevation than said rear opening, wherein the transition of internal flow-through of water under pressure from said front opening to said rear opening helps to lift water upward, to create a reciprocal downward force on the boat.

42. The method of claim 41, wherein the method comprises the step of providing an inlet gate on said front opening to restrict the introduction of water into said one or more cavities, and an outlet gate on said rear opening.

43. A wake enhancement device for use with a boat, comprising:

a boat hull having an exterior surface thereon and one or more cavities therein;

one or more openings on said boat hull, said one or more openings extending below the water line of said boat and being adapted such that when said boat travels through a body of water, water is introduced under pressure through at least one of said one or more openings into said one or more cavities, thereby increasing the effective weight of said boat, and creating a downward force that acts on said boat while said boat is traveling through said body of water, wherein the quality and size of the wake created by said boat can be enhanced; and wherein said one or more cavities are adapted such then when said boat slows down and/or stops, the pressure is reduced, and water in said one or more cavities is allowed to drain out through at least one of said one or more openings by gravity alone.

44. The device of claim 43, wherein said one or more cavities extends above said water line.

45. The device of claim 43, wherein one or more gates to control the entry or exit of water through said one or more openings is provided.

46. The device of claim 43, wherein one or more cowlings to help direct water into said one or more openings is provided.

47. The device of claim 43, wherein at least two openings are provided, one opening located near the front of said one or more cavities, and a second opening located near the rear of said one or more cavities, wherein said front opening is lower in elevation than said rear opening, such that the transition of internal flow-through of water under pressure from said front opening to said rear opening helps to lift water upward, which creates a reciprocal downward force on the boat.

48. The device of claim 47, wherein the rear opening is greater in size than the front opening.

49. The device of claim 47, wherein said front opening has a cowling extended therefrom to capture bow spray, and an inlet gate for restricting the introduction of water into said device.

* * * * *